US006975815B2

(12) United States Patent
Kato et al.

(10) Patent No.: US 6,975,815 B2
(45) Date of Patent: Dec. 13, 2005

(54) IMAGE-FORMING APPARATUS THAT DETERMINES A MAINTENANCE AVAILABILITY AND/OR TIME PERIOD

(75) Inventors: Hitoshi Kato, Ibaragi (JP); Norifumi Miyake, Chiba (JP); Tomokazu Nakamura, Chiba (JP); Kiyoshi Okamoto, Ibaragi (JP); Kiyoshi Watanabe, Chiba (JP); Takayuki Fujii, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 77 days.

(21) Appl. No.: 10/714,947

(22) Filed: Nov. 18, 2003

(65) Prior Publication Data

US 2005/0019043 A1 Jan. 27, 2005

(30) Foreign Application Priority Data

Nov. 25, 2002 (JP) ..... 2002-341351

(51) Int. Cl.[7] ..... G03G 15/00; G08B 21/00

(52) U.S. Cl. ..... 399/9; 399/81; 399/82; 340/679

(58) Field of Search ..... 399/9, 11, 81, 82, 399/107, 403, 405, 407, 408, 410; 340/679

(56) References Cited

U.S. PATENT DOCUMENTS

| | | | | |
|---|---|---|---|---|
| 4,682,158 | A * | 7/1987 | Ito et al. | 340/679 |
| 4,766,404 | A | 8/1988 | Ishida et al. | 355/7 |
| 5,006,890 | A | 4/1991 | Ishida et al. | 355/202 |
| 5,239,547 | A * | 8/1993 | Tomiyama et al. | 399/9 X |
| 6,327,446 | B1 * | 12/2001 | Suzuki | 399/11 X |
| 6,330,422 | B1 | 12/2001 | Sato et al. | 399/382 |
| 6,381,443 | B1 * | 4/2002 | Kawata et al. | 399/407 |
| 6,549,734 | B2 * | 4/2003 | Yamada et al. | 399/81 |
| 6,704,523 | B2 * | 3/2004 | Takeuchi et al. | 399/81 X |

* cited by examiner

*Primary Examiner*—Sandra L. Brase
(74) *Attorney, Agent, or Firm*—Fitzpatrick, Cella, Harper & Scinto

(57) ABSTRACT

An image-forming system is composed of an image-forming apparatus body, a folding device, a bookbinding device, and a finisher, which are connected to the image-forming apparatus body. In the image-forming system, in order to support maintenance, an available period of time for maintenance for each processing module (a unit or a device sectionalized in a processing functional unit) is calculated based on contents of a job presently in execution and contents of registered jobs so as to display the available period of time for maintenance of the calculated processing module on an operation display.

13 Claims, 30 Drawing Sheets

FIG. 15A

REGISTERED JOB

| REGISTRATION ORDER | ORIGINAL DOCUMENT | NUMBER OF COPIES | PRINTER | DOUBLE-SIDED UNIT | AUTOMATIC DOCUMENT FEEDER | FOLDING DEVICE | BOOKBINDING DEVICE | FINISHER |
|---|---|---|---|---|---|---|---|---|
| 1 | 60 | 30 | 1 | 0 | 0 | 0 | 0 | 1 |
| 2 | 15 | 60 | 1 | 1 | 0 | 0 | 1 | 0 |
| 3 | 20 | 10 | 1 | 0 | 0 | 1 | 0 | 1 |

FIG. 15B

WORK EFFICIENCY CPM OF IMAGE-FORMING APPARATUS

| OUTPUT SHEET SIZE | SINGLE-SIDED | DOUBLE-SIDED |
|---|---|---|
| A4 | 60cpm | 30cpm |
| A3 | 30cpm | 15cpm |

FIG. 15C

PROCESSING TIME OF POST PROCESSING DEVICE

| OUTPUT SHEET SIZE | SORT PROCESSING | | BOOKBINDING PROCESSING | | FOLDING PROCESSING | |
|---|---|---|---|---|---|---|
| | PROCESSING TIME IN BUNDLE | PROCESSING TIME BETWEEN BUNDLES | PROCESSING TIME IN BUNDLE | PROCESSING TIME BETWEEN BUNDLES | PROCESSING TIME IN BUNDLE | PROCESSING TIME BETWEEN BUNDLES |
| A4 | 0 | 0 | 0 | 0.5 | 0.01 | 0 |
| A3 | 0 | 0 | 0 | 0.5 | 0.02 | 0 |

FIG. 17A

SELECTION OF MAINTENANCE DEVICE

| | MAINTENANCE AVAILABLE TIME |
|---|---|
| PRINTER | 0 MIN |
| DOUBLE-SIDED UNIT | 30 MIN |
| BOOKBINDING DEVICE | 30 MIN |

TO NEXT

FIG. 17B

SELECTION OF MAINTENANCE DEVICE

| | MAINTENANCE AVAILABLE TIME |
|---|---|
| AUTOMATIC DOCUMENT FEEDER | 999 MIN |
| FINISHER | 0 MIN |
| FOLDING DEVICE | 120 MIN |

RETURN TO NEXT

FIG. 17C

SELECTION OF MAINTENANCE DEVICE

| | MAINTENANCE AVAILABLE TIME |
|---|---|
| COMMON CONVEYING UNIT | 0 MIN |
| FOLDING UNIT | 120 MIN |

RETURN O K

FIG. 18A

MAINTENANCE ITEM SELECTION OF FOLDING DEVICE

| | MAINTENANCE AVAILABLE TIME |
|---|---|
| ADJUSTMENT | 120 MIN |
| CLEANING | 120 MIN |
| PART REPLACEMENT | 120 MIN |

RETURN O K

FIG. 18B

MAINTENANCE ITEM SELECTION OF FOLDING DEVICE

| | MAINTENANCE AVAILABLE TIME |
|---|---|
| STOPPER POSITIONAL ADJUSTMENT | 120 MIN |
| FOLDING ROLLER CONTACT PRESSURE ADJUSTMENT | 120 MIN |

RETURN O K

FIG. 18C

| | PRESET VALUE | (RANGE) |
|---|---|---|
| FOLDING ROLLER CONTACT PRESSURE ADJUSTMENT | 5 | (1-20) |

MAINTENANCE AVAILABLE TIME 120 MIN

RETURN O K

FIG. 25A

MAINTENANCE PRIORITY ORDER LIST

| ITEM | WORK POSSIBILITY | WORK TIME | COUNTER | NEXT MAINTE-NANCE | STATE |
|---|---|---|---|---|---|
| CLEANING DOUBLE -SIDED PATH ROLLER | IMPOSSIBLE | 15 | 5000 | 3000 | NG |
| REPLACING READER HALOGEN LAMP | IMPOSSIBLE | 10 | 2000 | 1500 | NG |
| CLEANING COMMON TRANSFER ROLLER | IMPOSSIBLE | 15 | 7000 | 6800 | NG |
| CLEANING FOLDING PATH ROLLER | POSSIBLE | 10 | 3000 | 2900 | NG |
| REPLACING BOOKBINDING PATH ROLLER 2 | POSSIBLE | 30 | 1000 | 2000 | OK |

RETURN O K TO NEXT→

FIG. 25B

MAINTENANCE WORK TIME ORDER LIST

| ITEM | STANDBY TIME | WORK TIME | COUNTER | NEXT MAINTE-NANCE | STATE |
|---|---|---|---|---|---|
| CLEANING FOLDING PATH ROLLER | 15 | 10 | 3000 | 2900 | NG |
| FOLDING ROLLER CONTACT PRESSURE ADJUSTMENT | 15 | 10 | - | - | OK |
| FOLDING STOPPER POSITIONAL ADJUSTMENT | 15 | 10 | - | - | OK |
| CLEANING BOOKBINDING PATH ROLLER 1 | 30 | 10 | 1000 | 1200 | OK |
| CLEANING BOOKBINDING PATH ROLLER 3 | 30 | 15 | 1000 | 1300 | OK |

RETURN O K TO NEXT→

IMAGE-FORMING APPARATUS THAT DETERMINES A MAINTENANCE AVAILABILITY AND/OR TIME PERIOD

BACKGROUND OF THE INVENTION

1. Field of the Invention

The present invention relates to an image-forming apparatus having a plurality of processing modules including one or more processing modules with respect to an image-forming processing and one or more processing modules with respect to post processing.

2. Description of the Related Art

Hitherto, an image-forming apparatus has been provided, in which post-processing devices such as a finisher are connected to the image-forming apparatus such as a copying machine enabling various kinds of post-processing demanded by users such as bundle discharge processing, stitching processing, folding processing, and bookbinding processing to be performed. In order to enable these entire kinds of post-processing required from the users to be performed in one system, a plurality of post-processing devices executing each dedicated processing are sequentially connected to the image-forming apparatus.

In such an image-forming apparatus, there are provided covers arranged on outer casings of the image-forming apparatus and post-processing devices, the covers being openable/closable so that a worker such as a user or a service personnel can access inside of the apparatus in the case of jamming-recovery action performed by the user and maintenance carried out by the service personnel, such as part replacement, adjustment, and cleaning.

A conventional image-forming apparatus example having the above-mentioned covers provided thereon will be described with reference to FIG. 30. FIG. 30 is a longitudinal sectional view of an essential part of a conventional image-forming apparatus.

The conventional image-forming apparatus, as shown in FIG. 30, is provided with a printer 300 for forming images on a sheet by an electrophotographic process. The printer 300 includes an exposure control unit 110 having a polygon mirror 110*a*, a photosensitive drum 111, a development device 113, a transfer unit 116, a fixing unit 117, a flapper 121, a discharge roller 118, an inversing path 122, a double-sided transfer path 124, two cassettes 114 and 115, and a manual paper feeder 125. From the cassettes 114 and 115, the manual paper feeder 125, or the double-sided transfer path 124, a sheet is supplied and transferred between the photosensitive drum 111 and the transfer unit 116. Developed images formed on the photosensitive drum 111 are transferred on a sheet, which is supplied by the transfer unit 116, and the developed images transferred on the sheet are fused on the sheet in the fixing unit 117.

In the image-forming apparatus, covers 351 are provided to be openable/closable and accessible from the outside to the entire of a plurality of transfer paths for transferring sheets (including sheet-transferring paths from the cassettes 114 and 115 to the photosensitive drum 111, a transfer path for discharging sheets, the reversing path 122, and the double-sided transfer path 124). These covers 351 cannot be opened during normal image-forming operation, and are to be opened for jamming recovery action or maintenance during a down time. Therefore, if the cover 351 is opened during the image-forming operation, it is determined that an abnormal state is generated so as to stop the entire operation.

Also, to such a post-processing device disclosed in U.S. Pat. No. 6,330,422, a cover similar to that for the image-forming apparatus is provided.

However, in the image-forming apparatus described above, not all of sheets pass through the same transfer path, and depending on the setting by a user, the transfer path may differ in each sheet. For example, the sheet transfer path in a single-sided mode is different from that in a double-sided mode in the image-forming apparatus while in the post-processing device, the sheet transfer path differs among a stitching mode, a folding mode, and a bookbinding mode. Accordingly, the number of sheets passing through the transfer path is different from each other, resulting in different maintenance timing in each device or transfer path of the system. If part replacement is exemplified among kinds of maintenance, since each part itself has a different endurance limit to the number of sheets, even the number of passing through sheets is the same, maintenance timing is different in each device or each transfer path of the system.

Therefore, in a conventional structure of the system, opening the cover for maintenance stops the entire system. In the system having post-processing devices sequentially connected thereto, maintenance of the post-processing device can be carried out without stopping the entire system. In this case, however, it is necessary to remove the device for maintenance out of the system as well as to initialize the control unit for controlling the entire system again so as to recognize the connected post-processing device.

In such a manner, in a conventional image-forming apparatus, maintenance must be carried out with various timings, which produces the-shutdown of the entire system or the dismounting of the device and re-initialization involved therein. As a result, the maintenance reduces the system operating time, i.e., the system service factor.

SUMMARY OF THE INVENTION

It is an object of the present invention to provide an image-forming apparatus capable of avoiding system shutdown due to maintenance to the utmost.

In order to achieve the above-mentioned object, an image-forming apparatus according to the present invention comprises a plurality of processing modules including one or more processing modules regarding image-forming processing and one or more processing modules regarding post-processing; job registering means capable of registering a plurality of jobs; determining means for determining maintenance availability of each of the plurality of processing modules based on contents of a job presently in execution and contents of jobs registered in the job registering means; and displaying means for displaying determined results of the determining means.

In the image-forming apparatus, the displaying means may display the determined result of the determining means for every one of the processing modules.

In the image-forming apparatus, the displaying means may display the determined result of the determining means for every one of maintenance items.

In order to achieve the above-mentioned object, an image-forming apparatus according to the present invention comprises a plurality of processing modules including one or more processing modules regarding image-forming processing and one or more processing modules regarding post-processing; job registering means capable of registering a plurality of jobs; calculating means for calculating an available period of time for maintenance for every one of the processing modules based on contents of a job presently in execution and contents of jobs registered in the job registering means; and displaying means for displaying the available period of time for every one of the processing modules calculated by the calculating means.

In the image-forming apparatus, the displaying means may display the available period of time for maintenance calculated by the calculating means for every one of the processing modules.

In the image-forming apparatus, the displaying means may display the available period of time for maintenance calculated by the calculating means for every one of maintenance items.

The image-forming apparatus may further comprise determining means for determining presence of change in the available period of time for maintenance when cancellation is produced in the jobs registered in the job registering means during maintenance; and warning means for issuing a warning if the available period of time for maintenance of the processing module during maintenance is changed.

In the image-forming apparatus, the warning means may display information that the available period of time for maintenance of the processing module during maintenance is changed in the displaying means.

In the image-forming apparatus, the warning means may issue a warning sound that the available period of time for maintenance of the processing module during maintenance is changed.

In the image-forming apparatus, the maintenance items may be displayed by putting them in order of maintenance necessity.

In the image-forming apparatus, the maintenance items may be displayed by putting them in order of brevity of maintenance working hours.

Further objects, features and advantages of the present invention will become apparent from the following description of the preferred embodiments with reference to the attached drawings.

BRIEF DESCRIPTION OF THE DRAWINGS

FIG. 15A is a drawing showing a registered job example and contents thereof; FIG. 15B is a drawing showing a work efficiency CPM example of an image-forming apparatus body; and FIG. 15C is a drawing showing a processing time example of a post-processing device.

FIGS. 17A to 17C are drawings showing an operation screen example during maintenance.

FIGS. 18A to 18C are drawings showing an operation screen example during maintenance.

FIGS. 25A and 25B are drawings showing an operation screen example during maintenance under image-forming operation of the image-forming system according to the second embodiment of the present invention.

DESCRIPTION OF THE PREFERRED EMBODIMENTS

Embodiments according to the present invention will be described below with reference to the drawings.

First Embodiment

Figure 1:
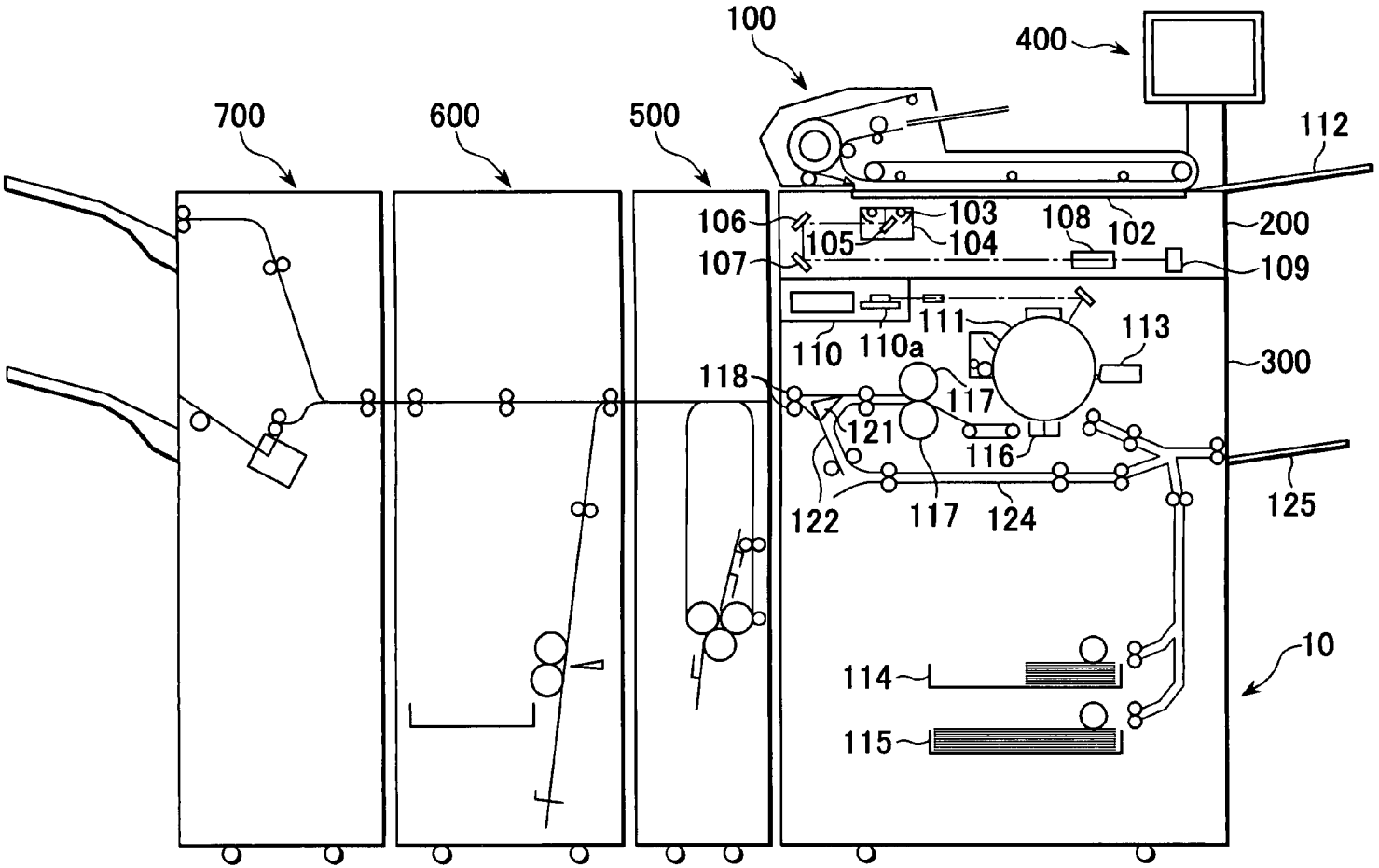
FIG. 1 is a schematic longitudinal sectional view of an essential part of an image-forming system according to a first embodiment of the present invention.

FIG. 1 is a schematically longitudinal sectional view of an essential part structure of an image-forming system according to a first embodiment of the present invention.

The image-forming system, as shown in FIG. 1, includes an image-forming apparatus body 10, a folding device 500, a bookbinding device 600, and a finisher 700. The image-forming apparatus body 10 includes an image reader 200 for reading an original document, a printer 300, and an operation display 400.

On the image reader 200, an original document feeder 100 is mounted. The original document feeder 100 feeds original documents upward placed on an original document tray one by one orderly from a beginning page in the left direction so as to be transferred on a platen glass 102 from the left to right via a skimming reading position after passing through a curved path. Then, the documents are discharged toward an outside taking-off tray 112. When the document passes through the skimming reading position on the platen glass 102 from the left to right, images of the document are read by a scanner unit 104 held at a position corresponding to the skimming reading position. This reading method is generally called as skimming reading. Specifically, when an original document passes through the skimming reading position, the reading surface of the original document is irradiated with light from a lamp 103 of the scanner unit 104 so that reflected light from the original document is led to a lens 108 via mirrors 105, 106, and 107. The light passed through the lens 108 is focused on an imaging surface of an image sensor 109.

By transferring the original document so as to pass through the skimming reading position from the left to right, reading scanning of the original document is performed, in which a main scanning direction is taken in the direction perpendicular to a transferring direction of the document while a secondary scanning direction is taken in the transferring direction. That is, by transferring the document in the secondary scanning direction while document images are read every one line in the main scanning direction by the image sensor 109 during passing through the skimming reading position of the document, the entire images of the document are optically read so that the read images are converted into image data and produced by the image sensor 109. The image data produced by the image sensor 109 is processed in a predetermined manner in an image-signal control unit 202, which will be described later, and then, it is entered in an exposure control unit 110 of the printer 300 as a video signal.

By scanning the document with the scanner unit 104 from the left to right in a state that the document is transferred on the platen glass 102 by the original document feeder 100 so as to stop at a predetermined position, the document can be also read. This reading method is so-called as fixed document reading.

When the document is read without using the original document feeder 100, first, the document is placed on the platen glass 102 by raising the original document feeder 100 by a user, and by scanning the document with the scanner unit 104 from the left to right, the document is read. That is, if the document is read without using the original document feeder 100, the fixed document reading is performed.

The exposure control unit 110 of the printer 300 modulates and produces laser light based on the entered video signal, so that a photosensitive drum 111 is irradiated with the laser light while being scanned with the laser light by a polygon mirror 110a. On the photosensitive drum 111, electrostatic latent images are formed corresponding to the scanning laser light. Wherein, during the fixed document reading, the exposure control unit 110 produces the laser light so as to form correct images (not inversion images).

The electrostatic latent images formed on the photosensitive drum 111 are made to be visible images as developed images by developer supplied from a development device 113. Then, a sheet is supplied from each of cassettes 114 and 115, a manual paper feeder 125, or a two-sided transfer path 124 to between the photosensitive drum 111 and a transfer unit 116 simultaneously with the irradiation initiation of the laser light. The developed images formed on the photosensitive drum 111 is transferred on the supplied sheet by the transfer unit 116.

The sheet having the developed images transferred thereon is conveyed to a fixing unit 117 so as to fix the images by thermally pushing them by the fixing unit 117. The sheet passed through the fixing unit 117 is discharged toward the outside (the folding device 500) from the printer 300 via a flapper 121 and a discharge roller 118.

When sheets are discharged in a state that the image-forming surface thereof faces downward (in face-down), after the sheet, which has passed through the fixing unit 117, is once led to a reversing path 122 by the switching operation of the flapper 121 and the trailing end of the sheet passes through the reversing path 122, the sheet is discharged from the printer 300 with the discharge roller 118 by switching the sheet. This discharge mode is called below as reverse discharge. The reverse discharge is performed during the image-forming orderly from a beginning page such as the formation of read images using the original document feeder 100 or the formation of images produced from a computer so that sheets after the discharge are correctly ordered.

When hard sheets such as OHP sheets are supplied from the manual paper feeder 125 so as to form images thereon, the sheets are discharged with the discharge roller 118 in a state that the image-forming surface thereof faces upward (in face-up) without leading the sheet to the reversing path 122.

In the case where two-sided recording is set for forming images on both surfaces of a sheet, after the sheet is once led to the reversing path 122 by the switching operation of the flapper 121, the sheet is conveyed to the two-sided transfer path 124. The sheet led to the two-sided transfer path 124 is controlled so as to supply it again between the photosensitive drum 111 and the transfer unit 116 in the timing mentioned above.

The sheet discharged from the printer 300 is conveyed to the folding device 500. This folding device 500 folds the sheet into a Z-shape. For example, in the case where a sheet with A3 or B4 size is assigned for a folding process, the sheet is folded by the folding device 500. In the other cases, the sheet discharged from the printer 300 is conveyed to the bookbinding device 600 and further to the finisher 700 after passing through the folding device 500. The bookbinding device 600 folds the sheet in halves so as to bind it. In the finisher 700, stitching operation and so forth are performed.

Figure 2:
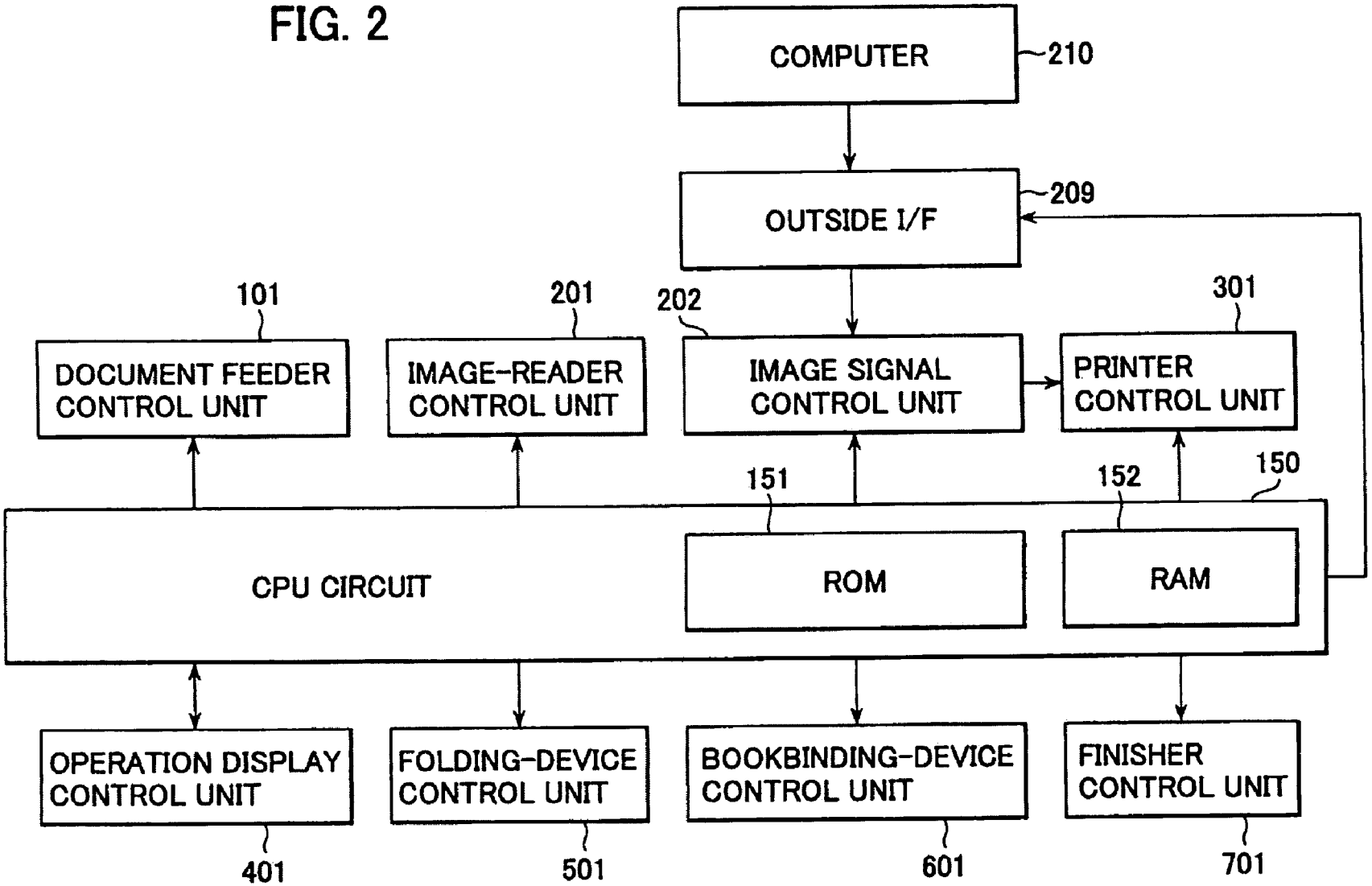
FIG. 2 is a block diagram of a controller for controlling the entire image-forming system shown in FIG. 1.

The configuration of a controller for controlling the entire image-forming system will be described with reference to FIG. 2. FIG. 2 is a block diagram showing the configuration of the controller for controlling the entire image-forming system shown in FIG. 1.

The controller, as shown in FIG. 2, includes a CPU circuit 150 having a CPU (not shown), a ROM 151, and a RAM 152 built therein so as to control overall blocks 101, 201, 202, 209, 301, 401, 501, 601, and 701 by a control program housed in the ROM 151. The RAM 152 temporarily stores control data and is used as a working region of computation processing involving in the control.

The document feeder control unit 101 controls to drive the original document feeder 100 based on the instruction from the CPU circuit 150. The image-reader control unit 201 controls to drive the above-mentioned scanner unit 104 and the image sensor 109 so as to transfer an analogue image signal produced from the image sensor 109 to the image-signal control unit 202.

The image-signal control unit 202 converts the analogue signal from the image sensor 109 into a digital signal; then, it converts the digital signal into a video signal by some processing so as to be produced from a printer control unit 301. The image-signal control unit 202 also converts a digital image signal entering from a computer 210 via an outside I/F 209 into a video signal by some processing so as to be produced from the printer control unit 301. The processing of the image-signal control unit 202 is controlled by the CPU circuit 150. The printer control unit 301 drives the above-mentioned exposure control unit 110 based on the entered video signal.

An operation display control unit 401 exchanges information between an operation display 400 (shown in FIG. 1) and the CPU circuit 150. The operation display 400, as will be described later, includes a plurality of keys for setting various functions and a display for displaying information showing setting states. A key signal corresponding to each key operation of the operation display 400 is produced from the CPU circuit 150 via the operation display control unit 401. The operation display control unit 401 controls the operation display 400 so as to display the corresponding information based on the signal from the CPU circuit 150.

A folding-device control unit 501 is mounted on the folding device 500, and controls and drives the entire folding device by exchanging information from the CPU circuit 150.

A bookbinding-device control unit 601 is mounted on the bookbinding device 600, and controls and drives the entire bookbinding device by exchanging information from the CPU circuit 150.

A finisher control unit 701 is mounted on the finisher 700, and controls and drives the entire finisher by exchanging information from the CPU circuit 150. The control content will be described later.

Figure 3:
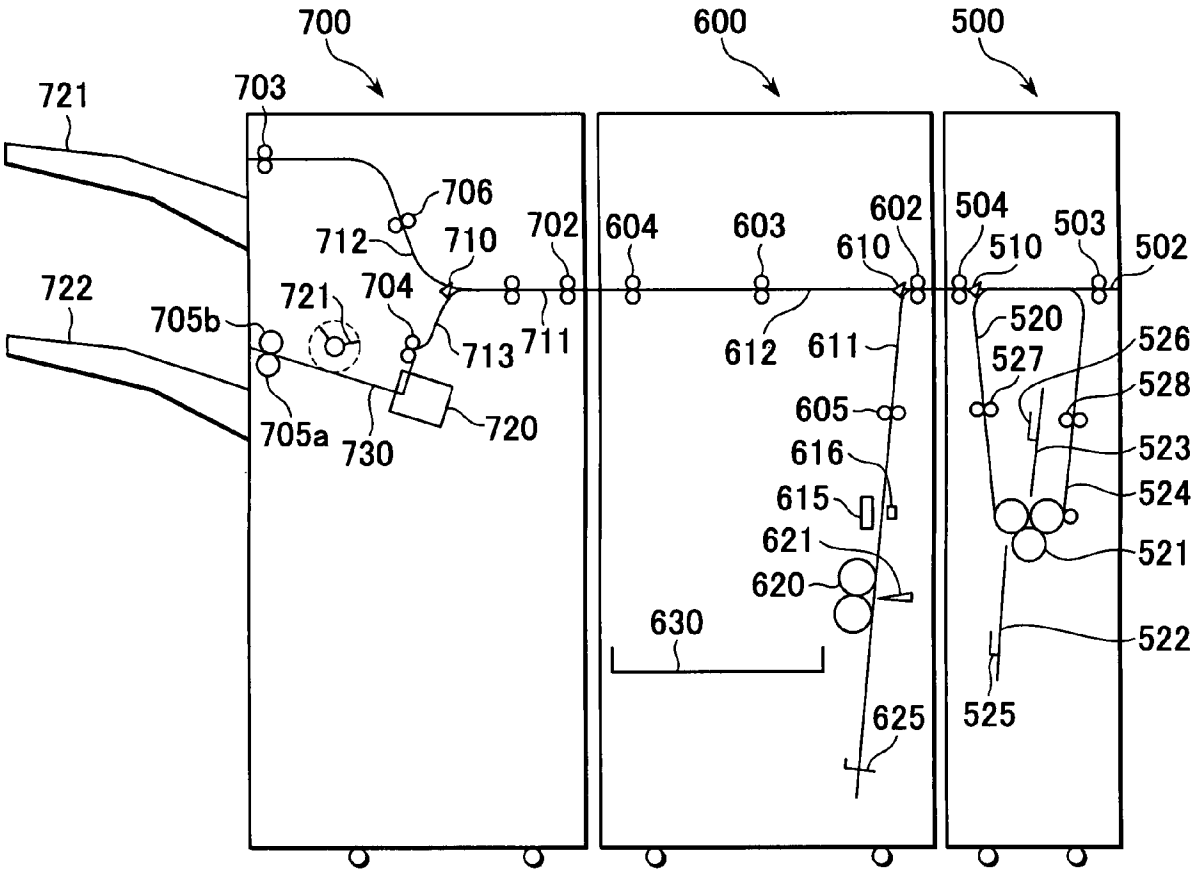
FIG. 3 is a drawing showing structures of a folding device 500 and a bookbinding device 600 shown in FIG. 1.

Next, structures of the folding device 500, the bookbinding device 600, and the finisher 700 will be described with reference to FIG. 3. FIG. 3 is a drawing showing the structures of the folding device 500, the bookbinding device 600, and the finisher 700 shown in FIG. 1.

The folding device 500, as shown in FIG. 3, includes a folding-transfer horizontal path 502 for leading the sheet discharged from the printer 300 to the bookbinding device 600. The folding-transfer horizontal path 502 is provided with a transfer roller pair 503 and a transfer roller pair 504 arranged thereon. At the exit.(adjacent to the bookbinding device 600) of the folding-transfer horizontal path 502, a folding-path selection flapper 510 is provided. The folding-path selection flapper 510 performs switching operation for leading the sheet on the folding-transfer horizontal path 502 to whether a folding path 520 or the bookbinding device 600.

Upon the folding, the folding-path selection flapper 510 is turned on so as to lead a sheet to the folding path 520. The sheet led to the folding path 520 is led to a folding path 522, and is conveyed until the leading edge arrives a first folding stopper 525. Then, simultaneously with being led to a folding path 523 by a folding roller 521, a quarter portion of the sheet from the leading edge is folded, and is conveyed until the edge arrives a second folding stopper 526. Furthermore, simultaneously with being led to a folding path 524 by the folding roller 521, the center of the sheet is folded into a Z-shape. Whereas, if the folding is not performed, the folding-path selection flapper 510 is turned off so that the sheet is directly conveyed from the printer 300 to the bookbinding device 600 via the folding-transfer horizontal path 502.

The bookbinding device 600 includes a bookbinding-transfer horizontal path 612 for receiving the sheet discharged via the folding device 500 and leading it toward the finisher 700. On the bookbinding-transfer horizontal path 612, transfer roller pairs 602, 603, and 604 are provided. At the inlet of the bookbinding-transfer horizontal path 612 (adjacent to the folding device 500), a bookbinding-path selection flapper 610 is provided. The bookbinding-path selection flapper 610 performs switching operation for leading the sheet on the bookbinding-transfer horizontal path 612 to whether a bookbinding path 611 or the finisher 700.

Upon the bookbinding, the bookbinding-path selection flapper 610 is turned on so as to lead a sheet to the bookbinding path 611. The sheet led to the bookbinding path 611 is conveyed by a transfer roller pair 605 until the leading edge of the sheet is brought into contact with a sheet positioning member 625. At an intermediate position of the bookbinding path 611, two pairs of staplers 615 are provided. The stapler 615 is structured to stable the center of a sheet bundle in cooperation with an anvil 616 opposing the stapler 615.

At a downstream position of the stapler 615, a folding roller pair 620 is provided. A protruding member 621 is arranged at a position opposing the folding roller pair 620. By protruding the protruding member 621 toward a sheet bundle accommodated in the bookbinding path 611, the sheet bundle is pushed between the folding roller pair 620, and is discharged to a bookbinding-discharge tray 630 after being folded by the folding roller pair 620.

If the sheet bundle stitched by the stapler 615 is folded, after the stapling, the sheet positioning member 625 is allowed to descend by a predetermined distance so that the staple position of the sheet bundle is located at the center of the folding roller pair 620.

Whereas, if the bookbinding is not performed, the bookbinding-path selection flapper 610 is turned off so that a sheet is conveyed from the folding device 500 to the finisher 700 via the bookbinding-transfer horizontal path 612.

The finisher 700 orderly receives discharged sheets via the folding device 500 and the bookbinding device 600, and performs various kinds of post-processing such as bundling processing where a plurality of received sheets are aligned into one bundle, stapling processing where the trailing edge of the aligned sheet bundle is stitched with staples, sorting processing, and non-sorting processing.

The finisher 700 includes an inlet roller pair 702 for leading the sheet discharged from the printer 300 via the folding device 500 and the bookbinding device 600 inside. The sheet conveyed by the inlet roller pair 702 is led to a finisher path 711. At a downstream position of the finisher path 711, a switching flapper 710 is arranged. The switching flapper 710 is for leading the sheet to a non-sort path 712 or a sort path 713.

Upon non-sorting, the switching flapper 710 is turned on so that a sheet is led to the non-sorter path 712. The sheet is discharged on a sample tray 721 via a transfer roller pair 706 disposed on the non-sorter path 712 and a non-sort discharge roller pair 703.

Whereas, if the stapling processing or the sorting processing is performed, the switching flapper 710 is turned on so that a sheet is led to the sort path 713. The sheet led to the sort path 713 is placed on an intermediate tray 730 via a discharge roller 704.

Sheets placed in a bundle on an intermediate tray 630 are discharged on a stack tray 722 by discharge rollers 705*a* and 705*b* after the staple processing is performed. For the stapling processing for binding the sheets placed on the intermediate tray 730 in a bundle, a stapler 720 is used therefor. The operation of the stapler 720 will be described later. The stack tray 722 is structured so as to be capable of being self-propelled in the vertical directions.

Figure 4:
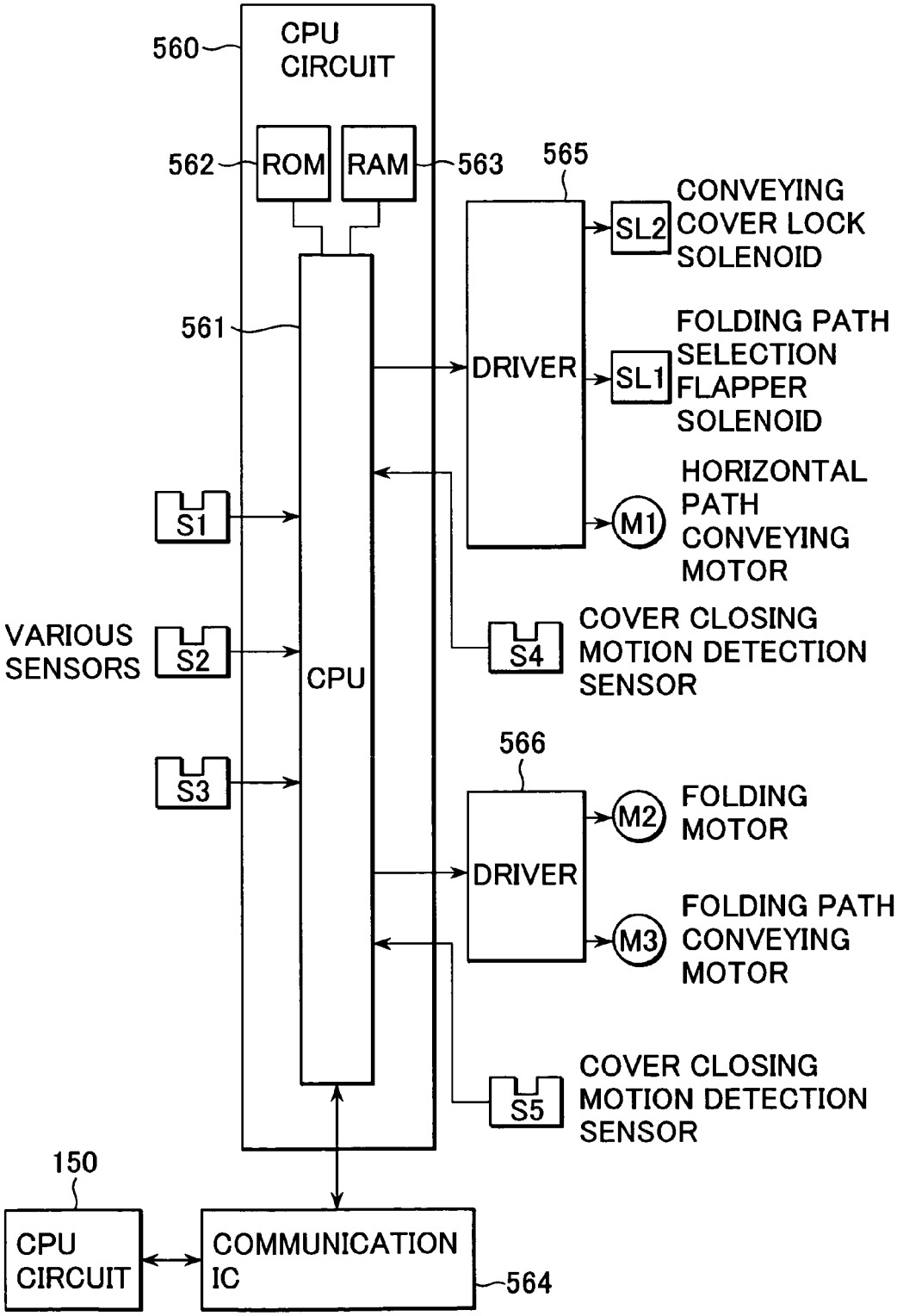
FIG. 4 is a block diagram of a folding-device control unit shown in FIG. 2.

Then, the configuration of a folding-device control unit 501 for driving and controlling the folding device 500 will be described with reference to FIG. 4. FIG. 4 is a block diagram of a folding-drive control section shown in FIG. 2.

The folding-device control unit 501, as shown in FIG. 4, includes a CPU circuit 560 having a CPU 561, a ROM 562, and a RAM 563, etc. The CPU circuit 560 communicates with the CPU circuit 150 disposed in the image-forming apparatus body 10 via a communication IC 564 so as to exchange data therewith. Thereby, on the basis of the instruction from the CPU circuit 150, the CPU circuit 560 executes various programs stored in the ROM 562 so as to control the driving of the folding device 500.

During the driving control, detected signals from various path sensors S1, S2, and S3 for detecting delay, detention, and jamming of conveyed sheets and detected signals from cover-closing motion detection sensors S4 and S5 are fetched into the CPU circuit 560. To the CPU circuit 560, drivers 565 and 566 are connected, wherein based on signals from the CPU circuit 560, the driver 565 drives a motor M1, a solenoid SL1, and a solenoid SL2 of a conveying function module while the driver 566 drives motors M2 and M3 of a folding function module.

Wherein, as the conveying function module, there are the horizontal path conveying motor M1 for driving the transfer roller pairs 503 and 504, the solenoid SL1 for switching the folding-path selection flapper 510, and the solenoid SL2 for locking a conveying cover 551; as the folding function module, there are the folding motor M2 for driving the folding roller 521 and the folding path conveying motor M3 for driving transfer rollers 527 and 528. Furthermore, the cover-closing motion detection sensor S4 is for detecting the closing motion of a cover 551, which will be described later, while the cover-closing motion detection sensor S5 is for detecting the closing motion of a cover 5S2, which will be described later.

Figure 5:
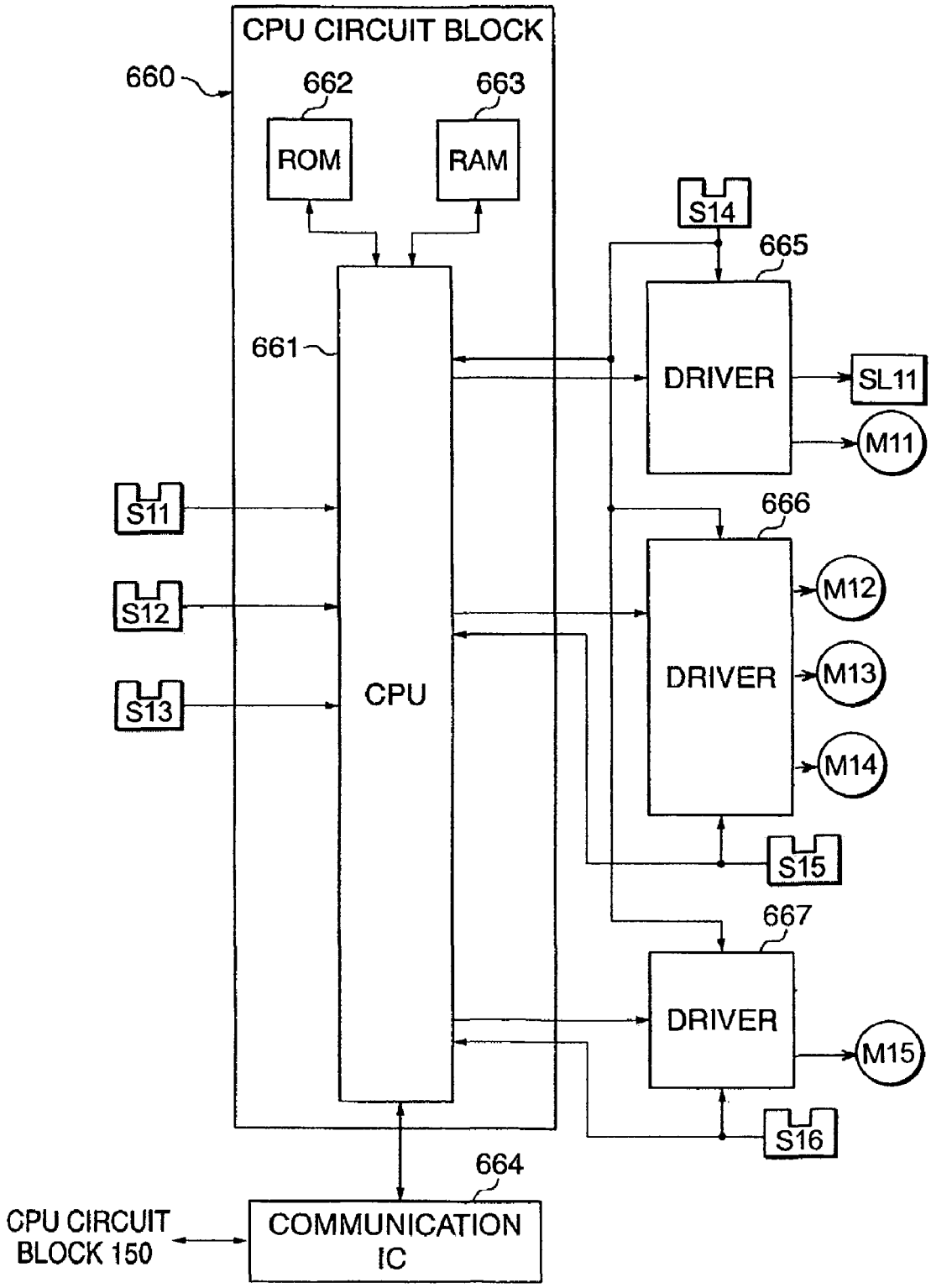
FIG. 5 is a block diagram of a bookbinding device control unit shown in FIG. 2.

Next, the bookbinding device control unit 601 for controlling to drive the bookbinding device 600 will be described with reference to FIG. 5. FIG. 5 is a block diagram of the bookbinding device control unit 601 shown in FIG. 2.

The bookbinding device control unit 601, as shown in FIG. 5, includes a CPU circuit 660 having a CPU 661, a ROM 662, and a RAM 663, etc. The CPU circuit 660 communicates with the CPU circuit 150 disposed in the image-forming apparatus body 10 via a communication IC 664 so as to exchange data therewith. Thereby, on the basis of the instruction from the CPU circuit 150, the CPU circuit 660 executes various programs stored in the ROM 662 so as to control the bookbinding device 600.

During the driving control, detected signals from the various path sensors S11, S12, and S13 and detected signals from the cover-closing motion detection sensors S14, S15, and S16 are fetched into the CPU circuit 660. To the CPU circuit 660, drivers 665, 666, 667 are connected, wherein based on signals from the CPU circuit 660, the driver 665 drives the motor M11 and the solenoid SL11 of the conveying function module; the driver 666 drives motors M12, M13, and M15 of a bookbinding function module; the driver 667 drives M14 of a placing function module.

Wherein, as the conveying function module, there are the horizontal path conveying motor M11 for driving the transfer roller pairs 602, 603, and 604 and the solenoid SL11 for switching the folding-path selection flapper 610; as a bookbinding function module, there are the folding motor M12 for driving the folding roller 620, the folding path conveying motor M15 for driving the transfer roller 605, and a positioning motor M13 for driving the sheet positioning member 625; and as a placing function module, there is a tray hoisting motor M14 for driving a bookbinding discharge tray 630. Furthermore, the cover-closing motion detection sensor S14 is for detecting the closing motion of a cover 651, which will be described later, while the cover-closing motion detection sensor S15 is for detecting the closing motion of a cover 653, which will be described later.

Figure 6:
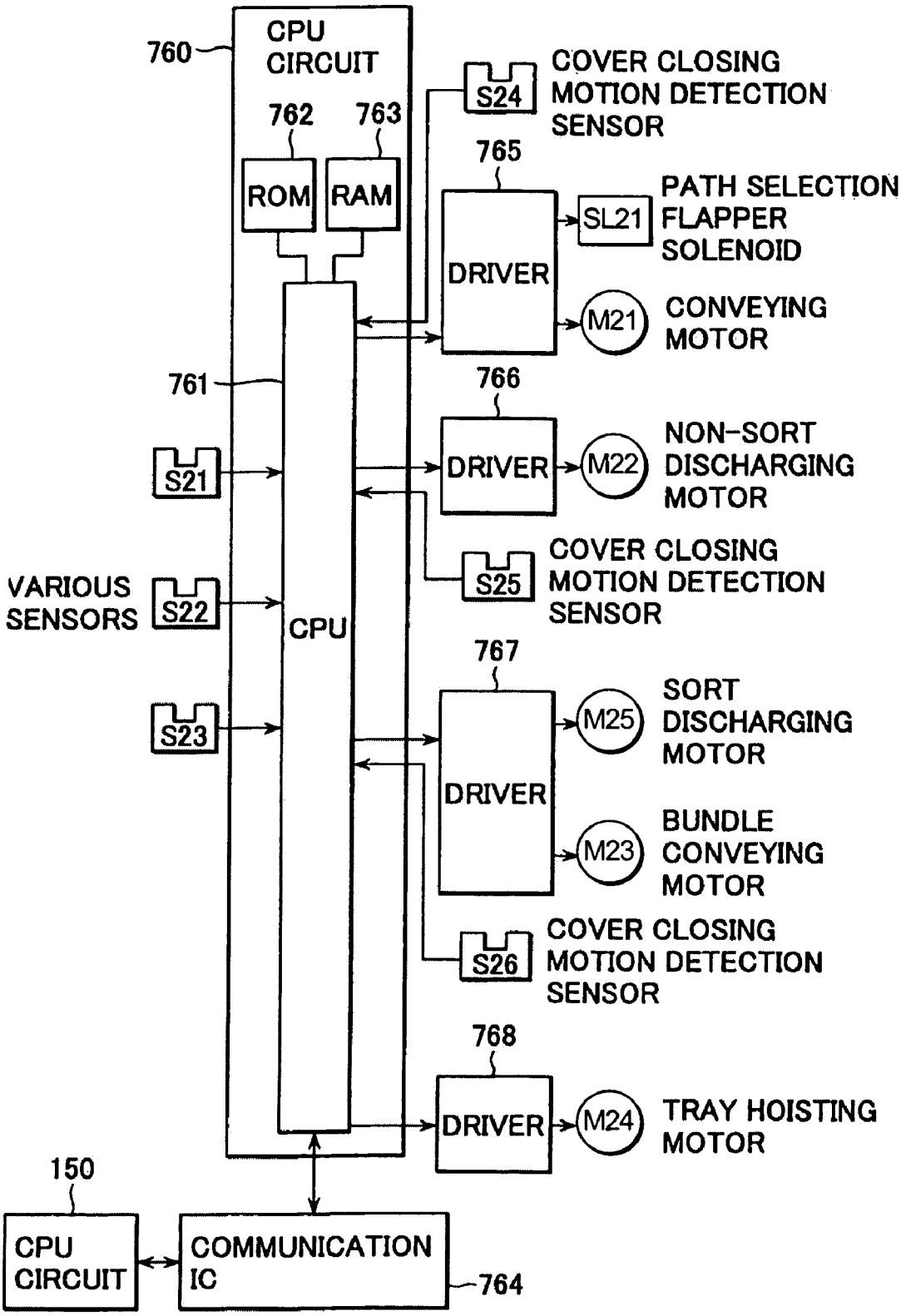
FIG. 6 is a block diagram of a finisher control unit shown in FIG. 2.

Next, the finisher control unit 701 for controlling to drive the finisher 700 will be described with reference to FIG. 6. FIG. 6 is a block diagram of the finisher control unit 701 shown in FIG. 2.

The finisher control unit 701, as shown in FIG. 6, includes a CPU circuit 760 having a CPU 761, a ROM 762, and a RAM 763, etc. The CPU circuit 760 communicates with the CPU circuit 150 disposed in the image-forming apparatus body 10 via a communication IC 764 so as to exchange data therewith. Thereby, on the basis of the instruction from the CPU circuit 150, the CPU circuit 760 executes various programs stored in the ROM 762 so as to control the finisher 700.

During the driving control, detected signals from the various path sensors S21, S22, and S23 and detected signals from the cover-closing motion detection sensors S24, S25, and S26 are fetched into the CPU circuit 760. To the CPU circuit 760, drivers 765, 766, 767, and 768 are connected, wherein based on signals from the CPU circuit 760, the driver 765 drives the motor M21 and the solenoid SL22 of the conveying function module; the driver 766 drives the motor M22 of a non-sort discharge function module; the driver 767 drives the motors M23 and M25 of a sort discharge function module; and the driver 768 drives the motor M24 of the placing function module.

Wherein, as the conveying function module, there are the conveying motor M21 for driving the inlet transfer roller pair 702 and the solenoid SL21 for switching the path selection flapper 710; as a non-sort discharge function module, there is the discharging motor M22 for driving the transfer roller pair 706 and the non-sort discharge roller 703; as a sort function module, there are the sort discharge motor M25 for driving the sort discharge roller 704 and the bundle conveying motor M23 for driving bundle discharge rollers 705*a* and 705*b*; and as a placing function module, there is the tray hoisting motor M24 for driving the stack tray 722. The conveying motor M21, the non-sort discharging motor M22, and the sort discharge motor M25 are stepping motors, so that by controlling an excitation pulse rate, the roller pair driven by each motor can be rotated at a constant speed or at an independent speed. The bundle conveying motor M23 is a DC motor.

The cover-closing motion detection sensor S24 is for detecting the closing motion of a cover 751, which will be described later. The CPU circuit 760, if it determines that the cover 751 is open based on the detected signal from the cover-closing motion detection sensor S24, turns the power supply of the driver 765 off so as to compulsorily stop driving the conveying function module while simultaneously turns the power supply of the drivers 766, 767, and 768 off so as to compulsorily stop driving the entire finisher 700. The cover-closing motion detection sensor S25 is for detecting the closing motion of a cover 752 and the cover-closing motion detection sensor S26 is for detecting the closing motion of a cover 751.

Figure 7:
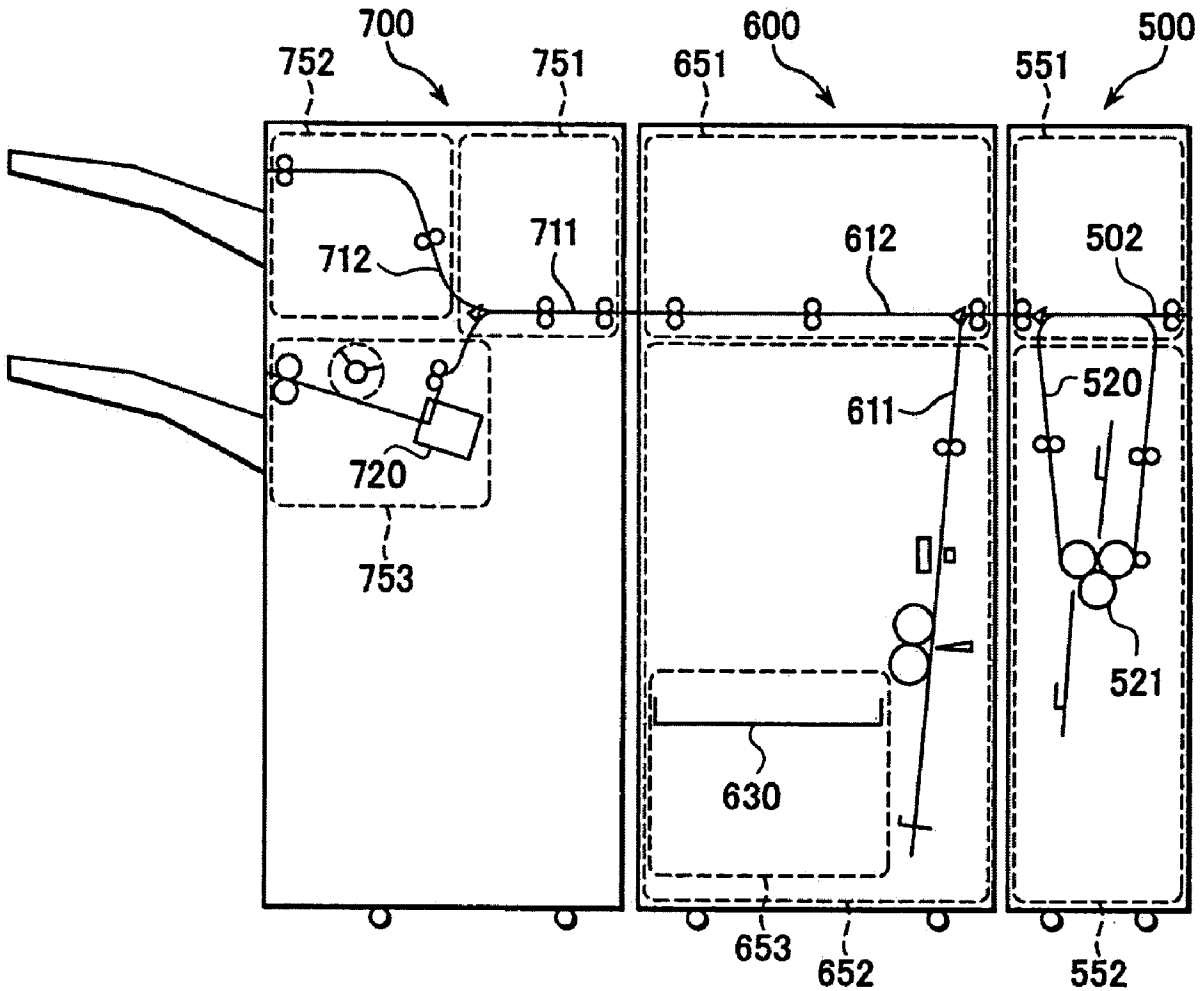
FIG. 7 is a schematic view of the arrangement of outer covers of the folding device 500, the bookbinding device 600, and a finisher 700.
Figure 8:
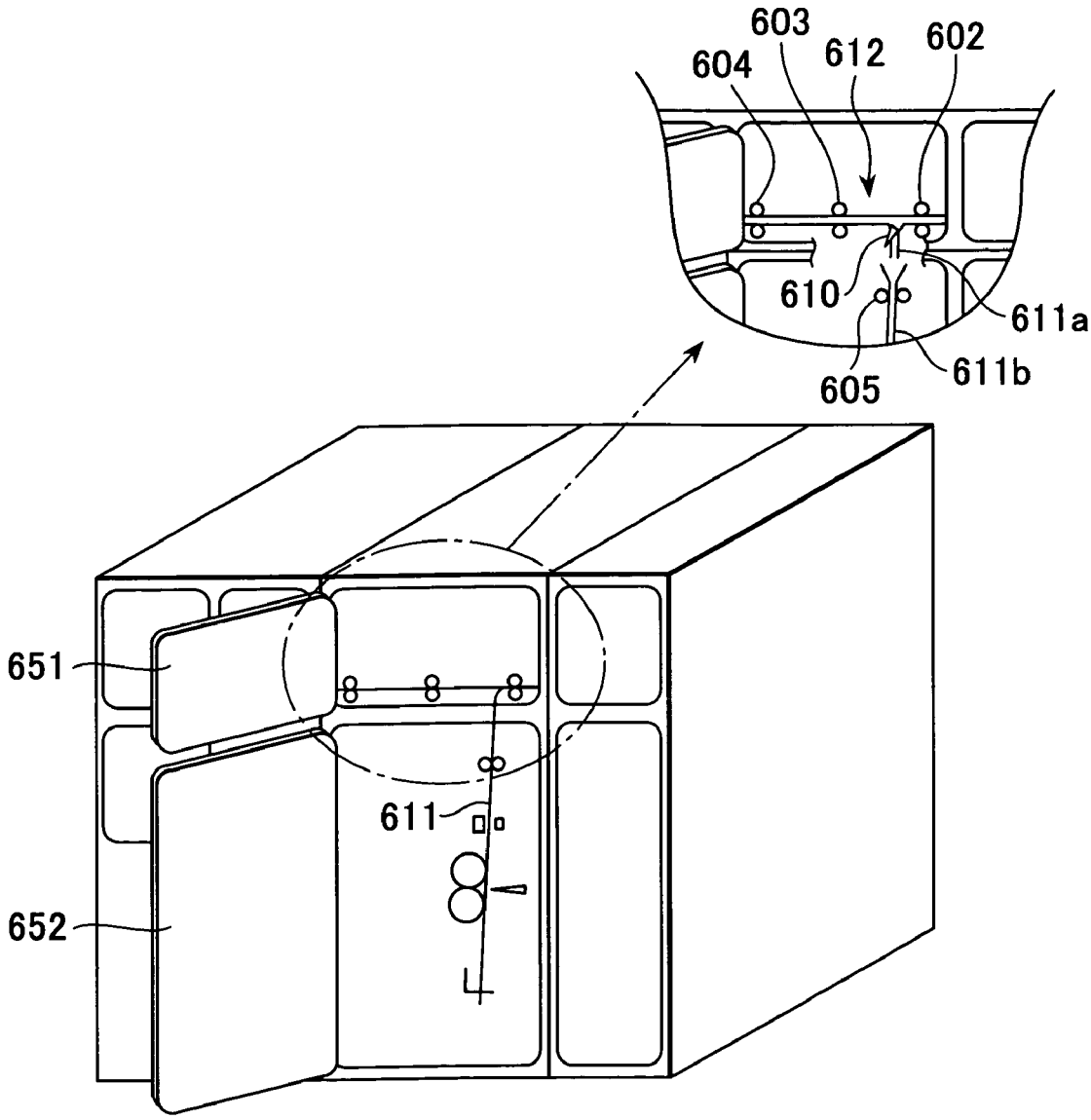
FIG. 8 is a schematic perspective view of a state that the cover of the bookbinding device 600 is opened so as to derive the corresponding module therefrom.
Figure 9:
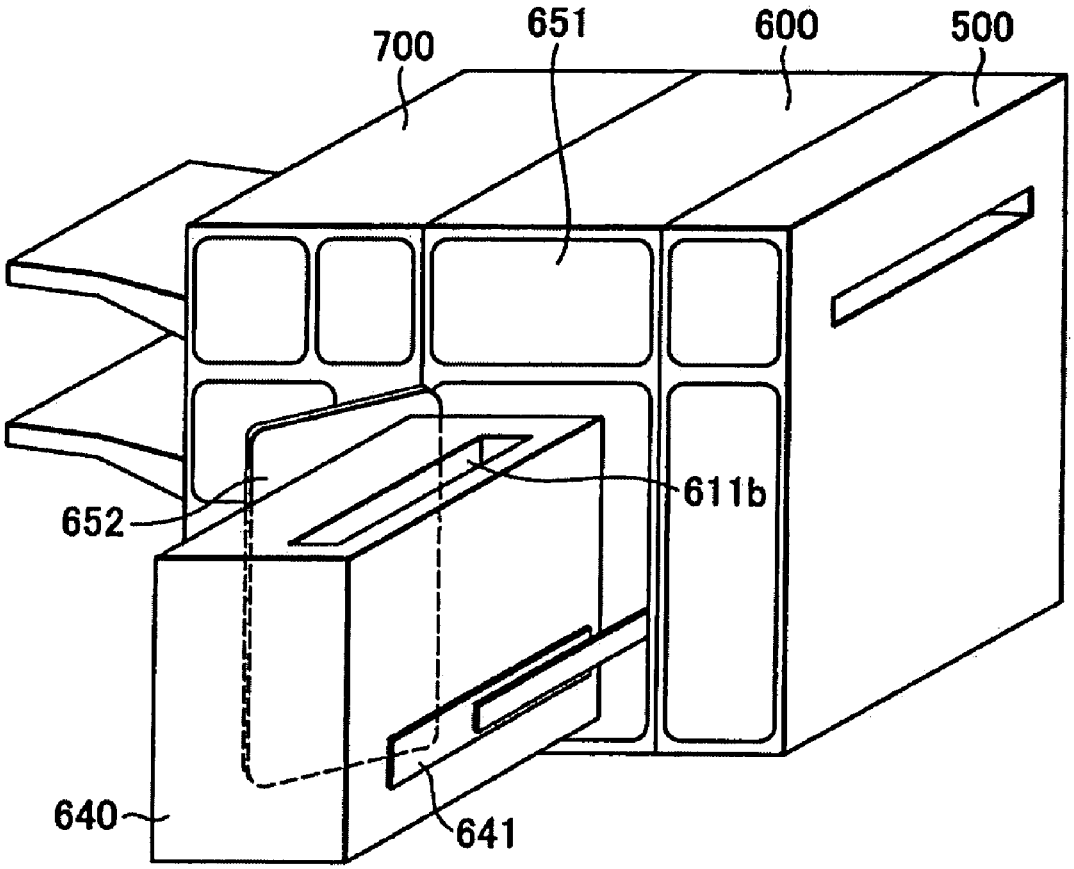
FIG. 9 is a schematic perspective view of a state that the cover of the bookbinding device 600 is opened so as to derive the corresponding module therefrom.
Figure 10:
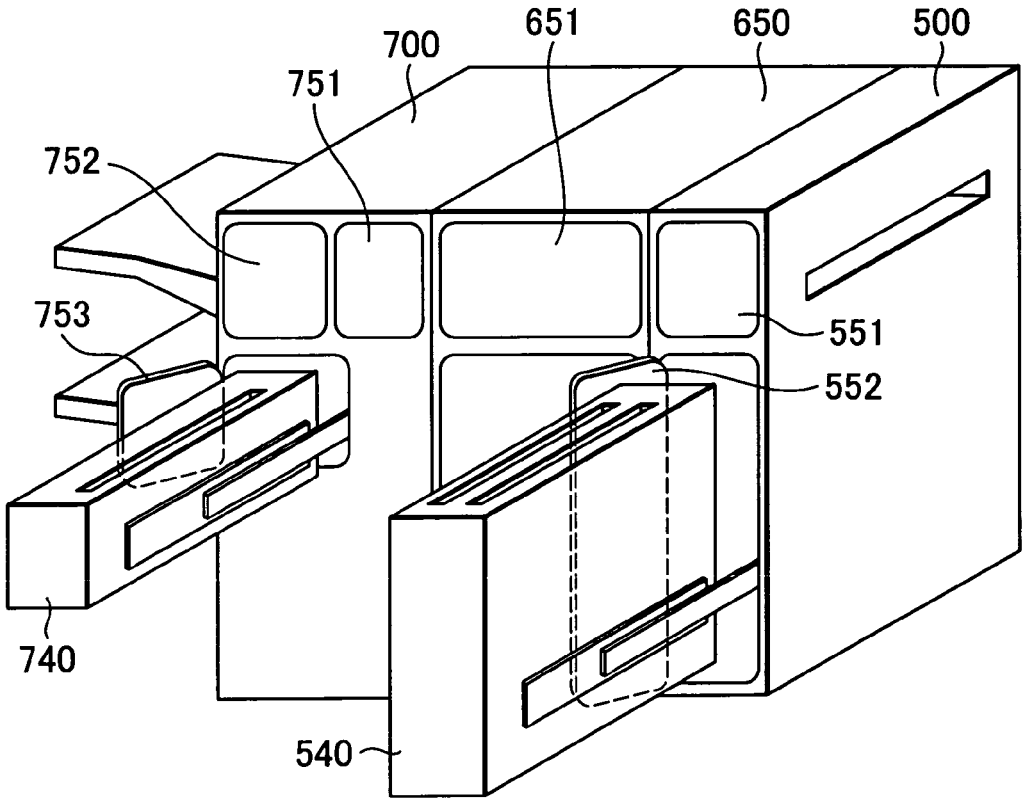
FIG. 10 is a schematic perspective view of a state that the covers of the folding device 500 and the finisher 700 are opened so as to derive the corresponding modules therefrom.

Next, a state that outer covers of the folding device 500, the bookbinding device 600, and the finisher 700 are opened so as to derive corresponding modules therefrom will be described with reference to FIGS. 7 to 10. FIG. 7 is a schematic view of the arrangement of the outer covers of the folding device 500, the bookbinding device 600, and the finisher 700; FIGS. 8 and 9 are schematic perspective views of a state that the cover of the bookbinding device 600 is opened so as to derive the corresponding module therefrom; and FIG. 10 is a schematic perspective view of a state that the covers of the folding device 500 and the finisher 700 are respectively opened so as to derive the corresponding modules therefrom.

The folding device 500, as shown in FIG. 7, includes the practicable cover 551 covering a horizontal path section including the folding-transfer horizontal path 502 and the practicable cover 552 covering a folding processing section including the folding path 520 and the folding roller 521. The covers 551 and 552 can be independently opened and closed, and are opened during maintenance such as jamming-recovery action, part replacement, cleaning, and adjustment. The closing motion of the covers 551 and 552 is detected by the above-mentioned cover-closing motion detection sensors. The covers 551 and 552 are provided with opening locking mechanisms (not shown). Wherein, if the cover 552 is opened, as shown in FIG. 10, the folding processing section 540 can be derived outside.

The bookbinding device 600, as shown in FIG. 7, includes the cover 651 covering a bookbinding processing section including the bookbinding-transfer horizontal path 612, a cover 652 covering a bookbinding processing section including the bookbinding path 611, and the cover 653 attached to the cover 652. The covers 651 and 652 can be independently opened and closed, and are opened during maintenance such as jamming-recovery action, part replacement, cleaning, and adjustment. The cover 653 can be opened and closed independently from the cover 652, and is opened when the bookbinding-processed sheet bundle discharged on the bookbinding-discharge tray 630 is derived outside. The closing motion of the covers 651, 652, and 653 is detected by the above-mentioned cover-closing motion detection sensors. The covers 651, 652, and 653 are provided with opening locking mechanisms (not shown).

Upon opening the cover 651 of the bookbinding device 600, as shown in FIG. 8, the bookbinding-transfer horizontal path 612, the bookbinding-path selection flapper 610, and the transfer roller pairs 602, 603, and 604 are accessible from the outside. The bookbinding path 611 is divided into an upper section 611*a* disposed in a bookbinding horizontal path section and a lower section 611*b* disposed in the bookbinding processing section. The upper section 611*a* of the bookbinding path 611 is accessible by opening the cover 651 of the bookbinding device 600. Also, upon opening the cover 652, as shown in FIG. 9, the modularized bookbinding processing section 640 including the lower section 611*b* of the bookbinding path 611 can be derived outside along a slide rail 641. Upon driving the bookbinding processing section 640, the lower section 611*b* of the bookbinding path 611, the transfer roller pair 605, the stapler 615, the folding roller pair 620, which are arranged along the downstream of the lower section 611*b*, are accessible.

The finisher 700, as shown in FIG. 7, includes the cover 751 covering the finisher path 711, the cover 752 covering the non-sort path 712, and a cover 753 covering a staple processing section including the stapler 720. The covers 751, 752, and 753 can be independently opened and closed, and are opened during maintenance such as jamming-recovery action, part replacement, cleaning, and adjustment. The closing motion of the covers 751, 752, and 753 is detected by the above-mentioned cover-closing motion detection sensors. The covers 751, 752, and 753 are provided with opening locking mechanisms (not shown). Wherein, if the cover 753 is opened, as shown in FIG. 10, a sort processing section 740 can be derived outside.

Figure 11:
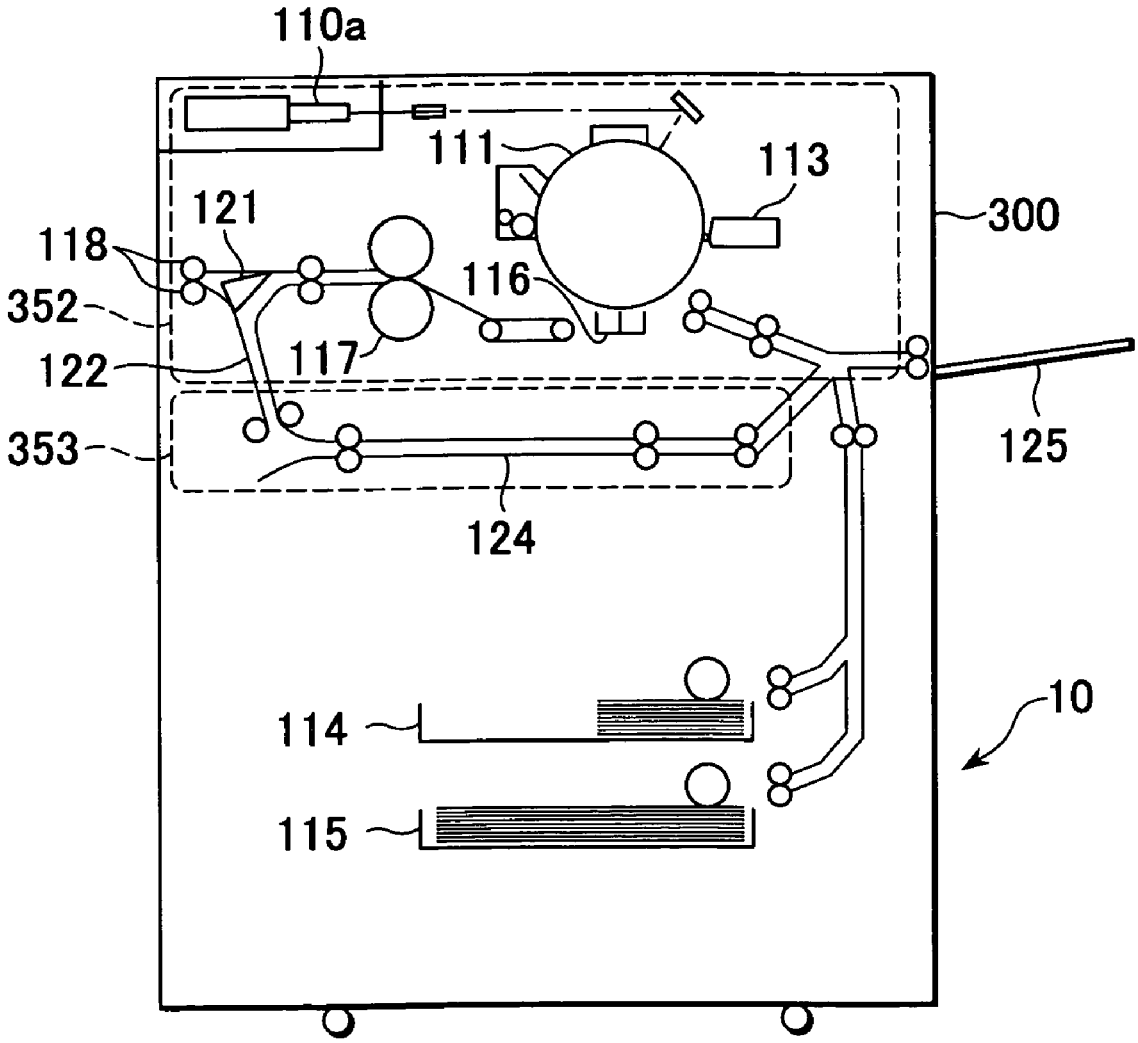
FIG. 11 is a schematic view of the arrangement of the outer cover disposed in the printer 300 of the image-forming apparatus body 10 shown in FIG. 1.

Next, the arrangement of an outer cover of the printer 300 of the image-forming apparatus body 10 will be described with reference to FIG. 11. FIG. 11 is a schematic view of the arrangement of the outer cover disposed in the printer 300 of the image-forming apparatus body 10 shown in FIG. 1.

The printer 300, as shown in FIG. 11, includes a cover 352 and a cover 353. The cover 352 is for covering the photosensitive drum 111, the transfer unit 116, the fixing unit 117, the flapper 121, and conveying paths for leading sheets to them. Wherein, in any of single-sided image forming and double-sided image forming, a sheet is conveyed on the conveying paths. The cover 353 is for covering the double-sided transfer path 124. The covers 352 and 353 can be independently opened and closed, and are opened during maintenance such as jamming-recovery action, part replacement, cleaning, and adjustment. The closing motion of the covers 352 and 353, in the same way as in the folding device 500, the bookbinding device 600, and the finisher 700, is detected by cover-closing motion detection sensors (not shown). The covers 352 and 353 are provided with opening locking mechanisms (not shown).

Upon opening the cover 353, the driver for driving the transfer roller pair arranged on the double-sided transfer path 124 is turned off so that the stopping state of the transfer roller pair is maintained. Upon opening the cover 352, the entire driving sections of the printer 300 covered with the cover 352 including the photosensitive drum 111 and the fixing unit 117 are stopped. Therefore, even when the cover 353 is opened for the maintenance such a roller cleaning in the double-sided transfer path 124, the image-forming operation is not stopped.

In such a manner, by dividing the cover every transfer path, even during the image-forming operation, in sections where a sheet is not conveyed, the maintenance of the processing modules can be performed by opening the cover. Thereby, even performing maintenance of each processing module at various timings, the downtime of the system can be reduced.

Figure 12:
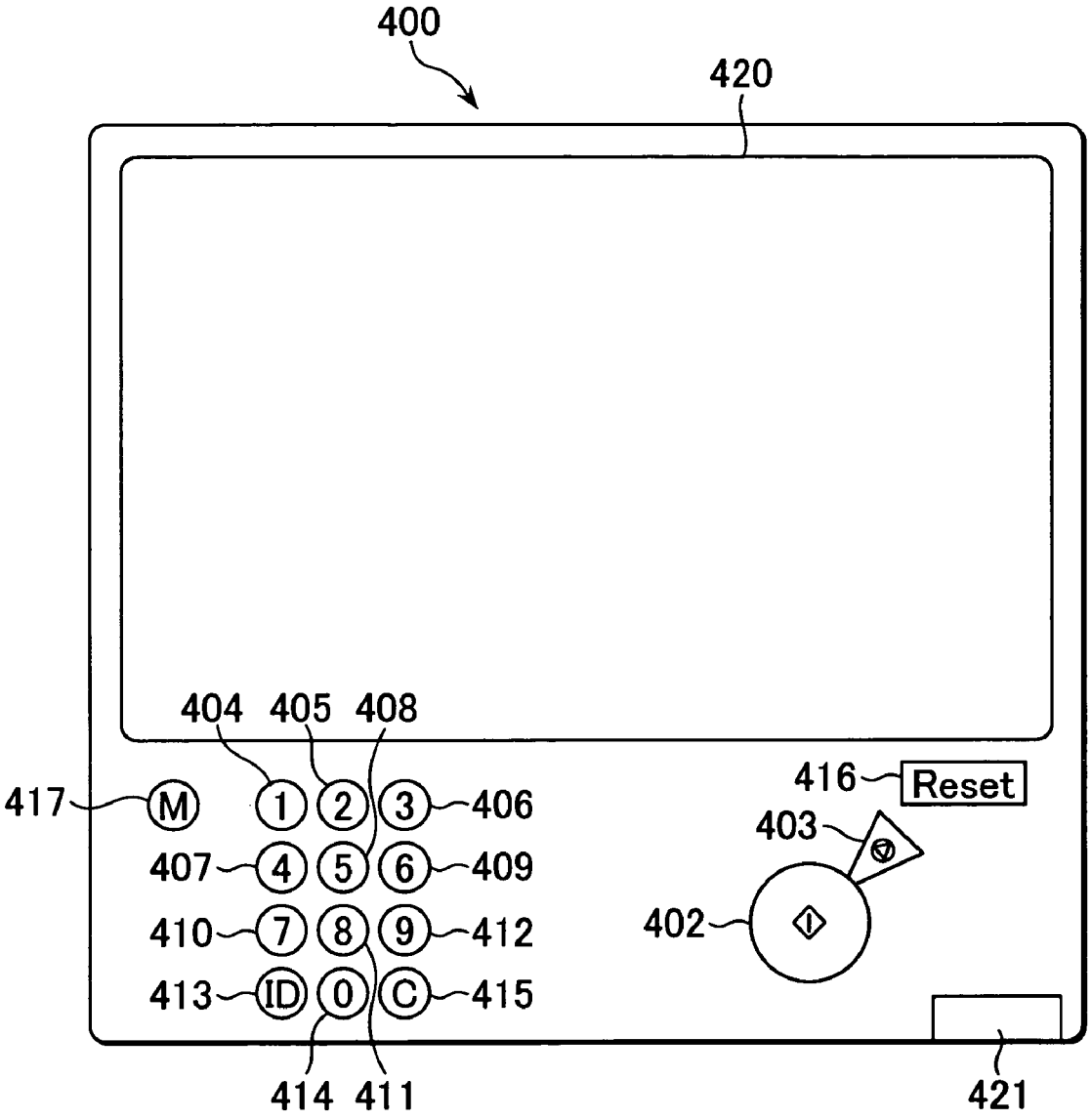
FIG. 12 is a drawing showing an overview of an operation display 400 shown in FIG. 1.
Figure 13:
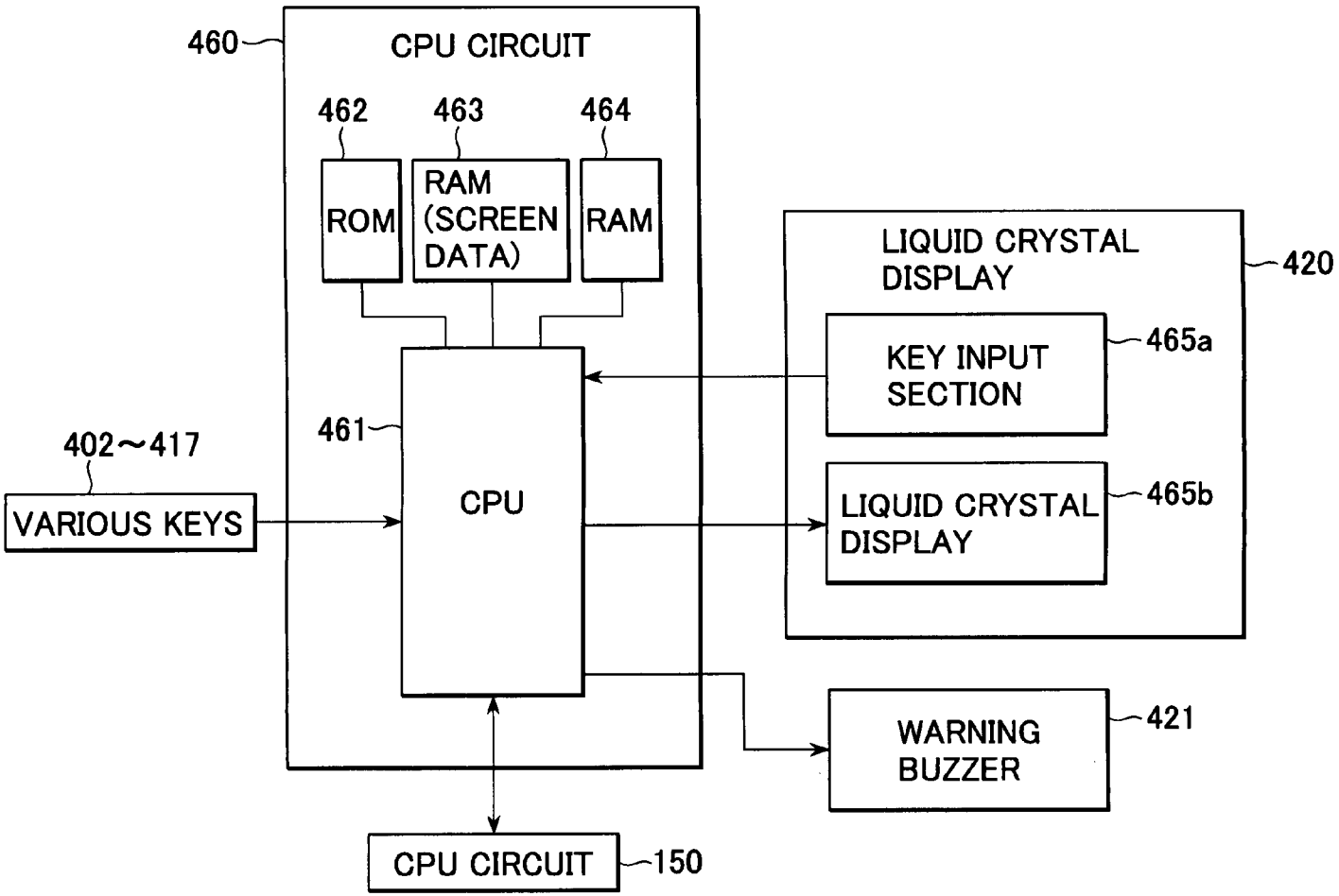
FIG. 13 is a block diagram of an operation display control unit 401 shown in FIG. 2.
Figure 14A:
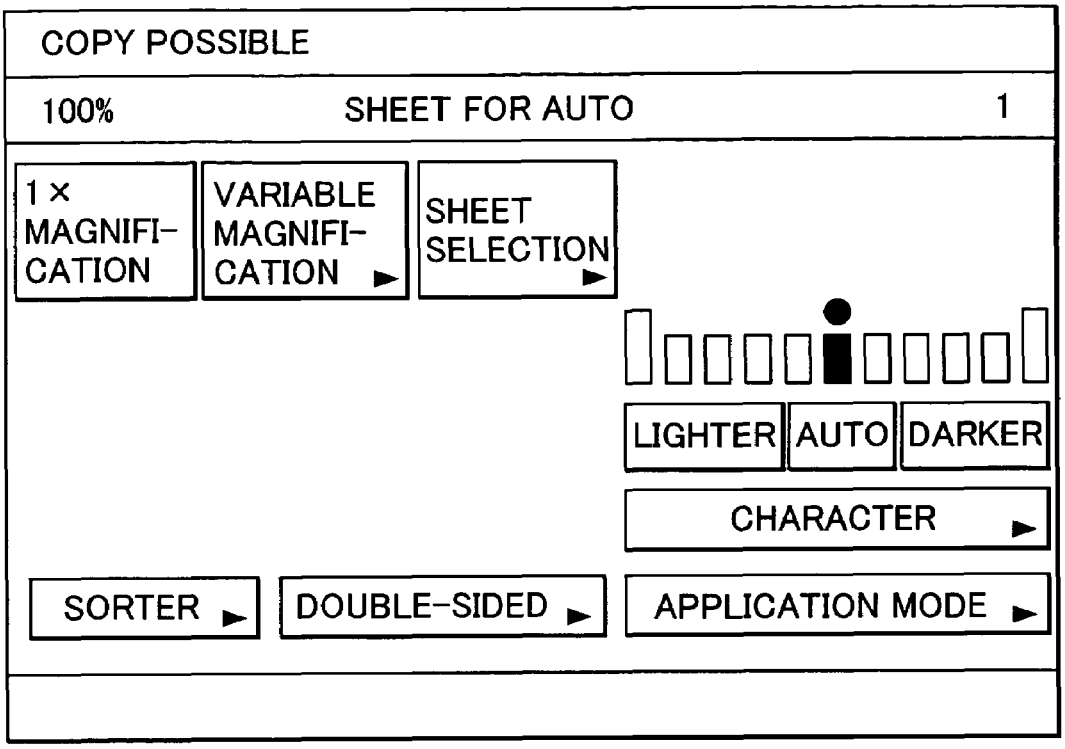
FIG. 14A is a drawing showing an initial screen example displayed on the operation display 400.
Figure 14B:
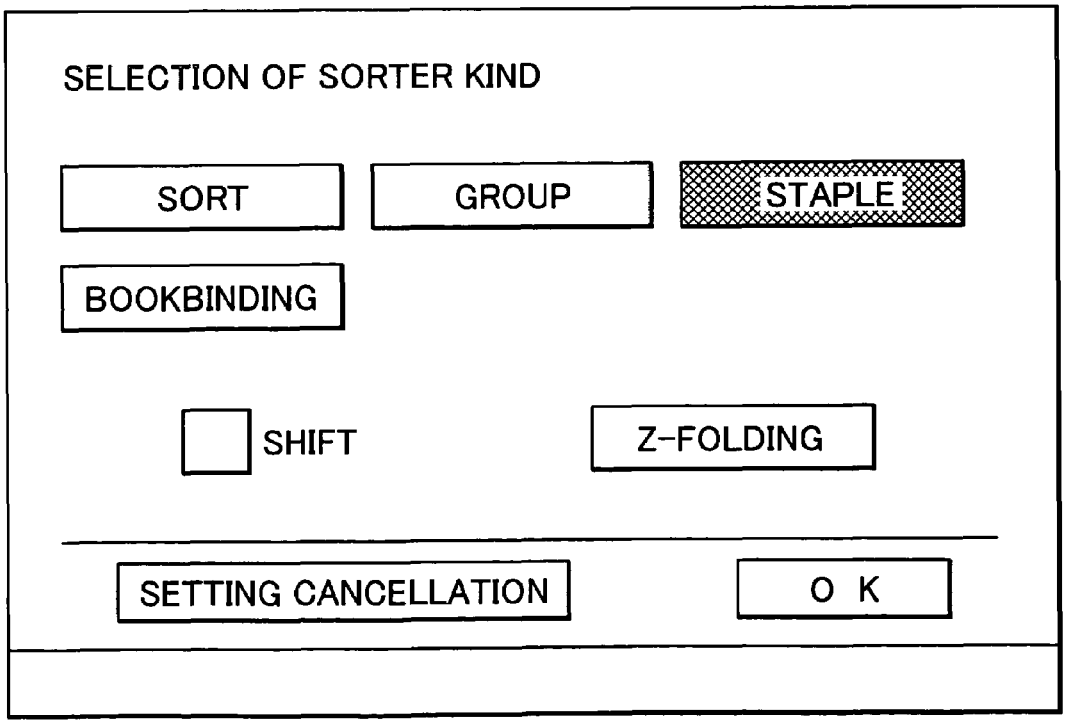
FIG. 14B is a drawing showing a menu selection screen example displayed on the operation display 400.

Next, the operation display 400 and the operation display control unit 401 will be described with reference to FIGS. 12 to 14. FIG. 12 is a drawing showing an overview of the operation display 400 shown in FIG. 1; FIG. 13 is a block diagram of the operation display control unit 401 shown in FIG. 2; FIG. 14A is a drawing showing an initial screen example displayed on the operation display 400; and FIG. 14B is a drawing showing a menu selection screen example displayed on the operation display 400.

The operation display 400, as shown in FIG. 12, is provided with various keys arranged thereon, such as a start key 402 for starting to operate image-forming, a stop key 403 for suspending the image-forming, ten-keys 404 to 412, and 414 for numerical registration, an ID key 413, a clear key 415, a reset key 416, and a maintenance key 417, and a warning buzzer 421. In an upper portion of the operation display 400, a liquid crystal display 420 having a touch panel formed thereon is arranged, and on the screen of the display 420, soft keys may be provided.

The operation display control unit 401, as shown in FIG. 13, includes a CPU circuit 460 composed of a CPU 461, a ROM 462, and RAMs 463 and 464. In the RAM 463, various screen data are stored for displaying on the liquid crystal display 420. The RAM 464 is used for a work area of the CPU 461. The liquid crystal display 420 is composed of a keystroke section 465*a* operated by soft keys on the touch panel and a liquid crystal display 465*b*.

The CPU 461 of the CPU circuit 460 communicates with the CPU circuit 150 disposed adjacent to the image-forming apparatus body 10 so as to exchange data therewith. Thereby, on the basis of the instruction from the CPU circuit 150 and inputs from the various keys 402 to 416, and 465*a*, the CPU 461 executes various programs stored in the ROM 462 and produces the screen data stored in the RAM 463 so as to display them on the liquid crystal display 465*b*.

The image forming system includes various processing modes as post-processing modes, such as a non-sort (group), a sort, a staple sort (stitching mode) and a bookbinding mode. The setting of such a processing mode is performed by input operation from the operation display 400. During the setting of the post-processing mode, for example, if a soft key "sorter" on the main screen shown in FIG. 14A is selected, a sorter kind selection screen shown in FIG. 14B is displayed on the liquid crystal display 420 so as to set the processing mode using this screen.

Figure 16:
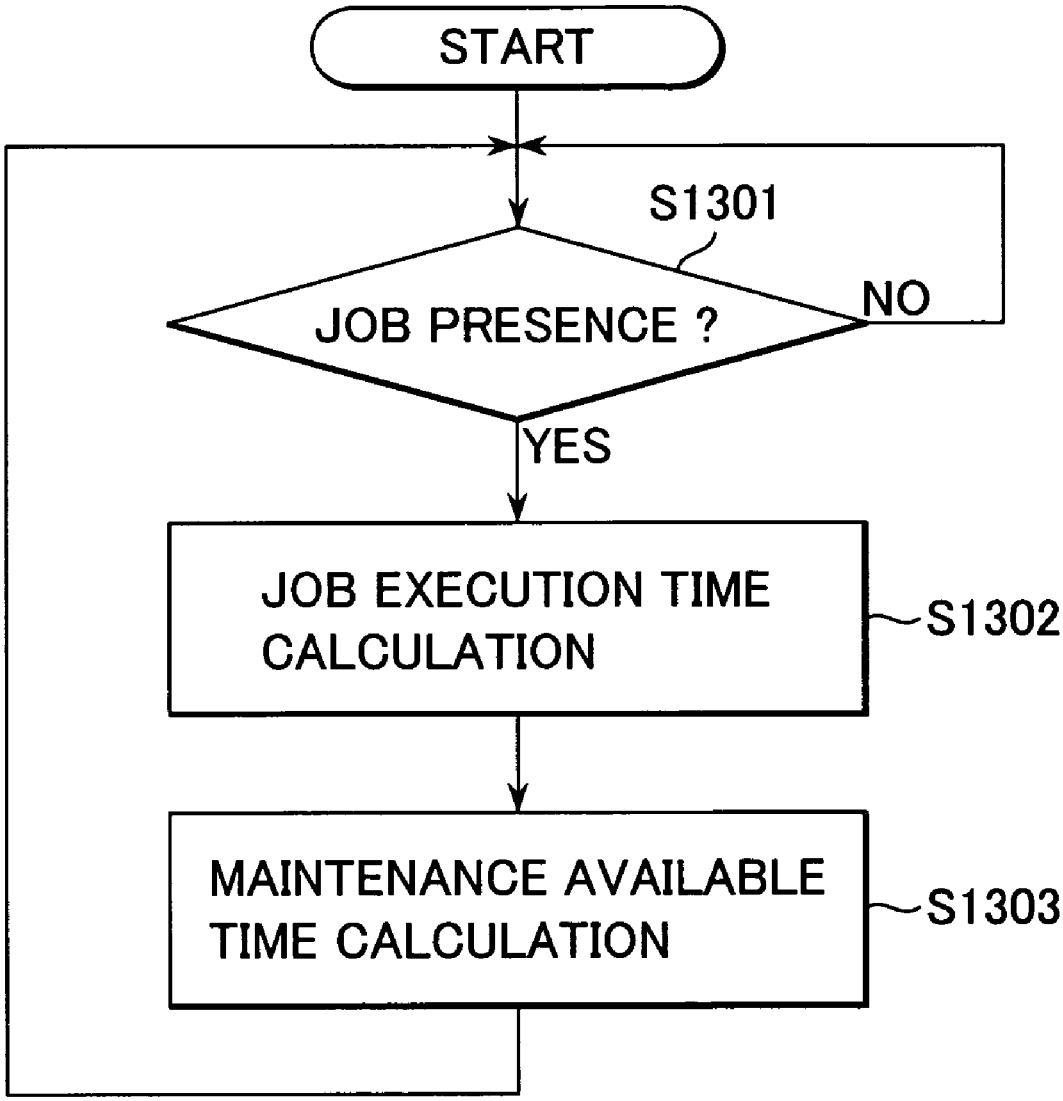
FIG. 16 is a flowchart showing a calculation procedure of an available period of maintenance.

Next, a maintenance assistance method for use in the image-forming system will be described with reference to FIGS. 15A to 16. FIG. 15A is a table showing a registered job example; FIG. 15B is a table showing a work efficiency CPM (copy per minute) example; and FIG. 15C is a table showing a processing time example of post-processing devices. FIG. 16 is a flowchart showing a calculation procedure of an available period of maintenance.

According to the embodiment, in order to assist maintenance, on the basis of contents of a job presently in execution and contents of registered jobs, an available period of time for maintenance for each processing module (a unit or a device sectionalized in a processing functional unit) is calculated so as to display the available period of time for maintenance of the calculated processing module.

First, registered jobs will be described. Jobs to be processed in the system are entered from a computer via the operation display 400 and a network, and are registered. During the job registration, job contents including information such as a kind of device for use in the job are stored in the RAM 152. For example, as shown FIG. 15A, a registration order, the number of original documents, the number of copies, and a kind of device are stored in the RAM 152 for each job. Wherein, the device number used in the job is indicated by "1", and the device number not used in the job is indicated by "0".

In the RAM 152 or the ROM 151, the table (FIG. 15B) showing the work efficiency of the image-forming apparatus and the table (FIG. 15C) showing the processing period of time of the post-processing devices are stored.

The executing time of a registered job is obtained from the following formula:

> The executing time=the number of the original documents×the number of copies/CPM+the number of the original documents×the number of copies×the processing time in a bundle+the number of copies×the processing time between bundles. For example, in the case where "60 original documents, 30 copies, single-sided image-forming mode, and a sort processing mode", the executing time is 60×30/60+60×30×0+30×0=30 minutes.

The executing time of an executing job is obtained from the following formula:

The executing time=(the residual number of sheets/CPM +the residual number of sheets×the processing time in a bundle+the processing time between bundles)+(the number of the original documents×the residual number of copies/CPM+the number of the original documents×the residual number of copies×the processing time in a bundle +the number of copies×the processing time between bundles). For example, in the case where "60 original documents, 30 copies, single-sided image-forming mode, and a sort processing mode", when the processing is terminated until the 30th sheet of the 10th copy, the residual number of sheets becomes 60−30=30 and the residual number of copies becomes 30−10=20, so that the executing time is (30/60+30×0+0)+(60×20/60+60×20×0+20×0)= 20.5 minutes.

The available period of time for maintenance for each processing module is expressed in units of 5 minutes, so that if the number of the first digit of the calculated maintenance available time is 0 to 4, it is expressed as 0 while being 5 to 9, it is expressed as 5. For example, if the calculated maintenance available time is 20.5 minutes, it is expressed as 20 minutes.

Next, an example of the maintenance available time calculation will be described. Wherein, if the first job shown in FIG. 15A has the maintenance directly before execution, as for the first job, "printer" and "finisher" are "0" so as to be used, so that the maintenance available time of "printer" and "finisher" is 0 minute. As for the maintenance available time of "double-sided unit" and "bookbinding device", in the jobs presently in execution (first jobs), "double-sided unit" and "bookbinding device" are "0" while in the second job, "double-sided unit" and "bookbinding device" are "1", so that the period of time until the initiation of the second jobs is calculated as the maintenance available time of "double-sided unit" and "bookbinding device". Therefore, the execution time of the first job, which is 30 minutes, becomes the maintenance available time of "double-sided unit" and "bookbinding device".

Also, as for the maintenance available time of "automatic document feeder", the entire registered jobs are "0", so that the maximum period of time, which is 999 minutes, becomes the maintenance available time.

Also, as for the maintenance available time of "folding device", the third job shown in FIG. 15A is "1", so that the sum of the first job executing time 30 minutes and the second job executing time 90 minutes, which is 120 minutes, becomes the maintenance available time.

The calculation of the above-mentioned maintenance available time is performed by the CPU circuit 150 according to the program stored in the ROM 151. In the calculation, specifically, first, the presence of the executing job or the registered job is determined in Step S1301 as shown in FIG. 16. If the executing job or the registered job is determined not present, the step is returned to Step S1301. In the Step S1301, if the executing job or the registered job is determined present, the executing time of the executing job and the registered job is calculated in Step S1302. Then, in Step S1303, the maintenance available time for each processing module (unit or device) is calculated based on the job executing time calculated in Step S1302, so as to store the calculated result in the RAM 152.

The maintenance available time is constantly updated while the maintenance available time is displayed by reading the time stored in the RAM 152 at predetermined intervals of time.

Figure 19A:
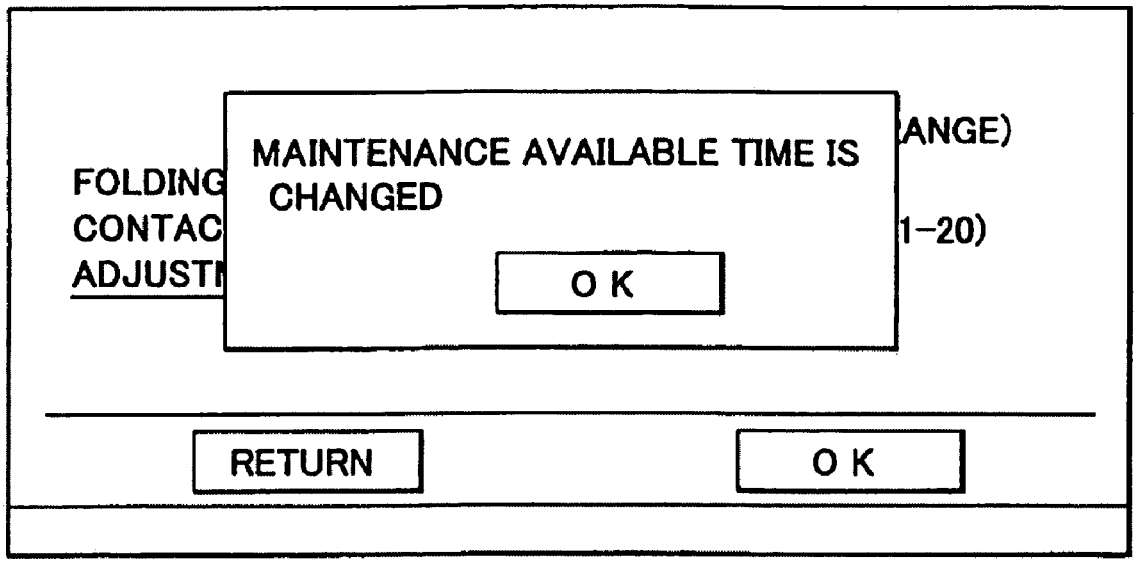
FIG. 19A is a drawing showing a warning screen example when the maintenance available time is reduced.
Figure 19B:
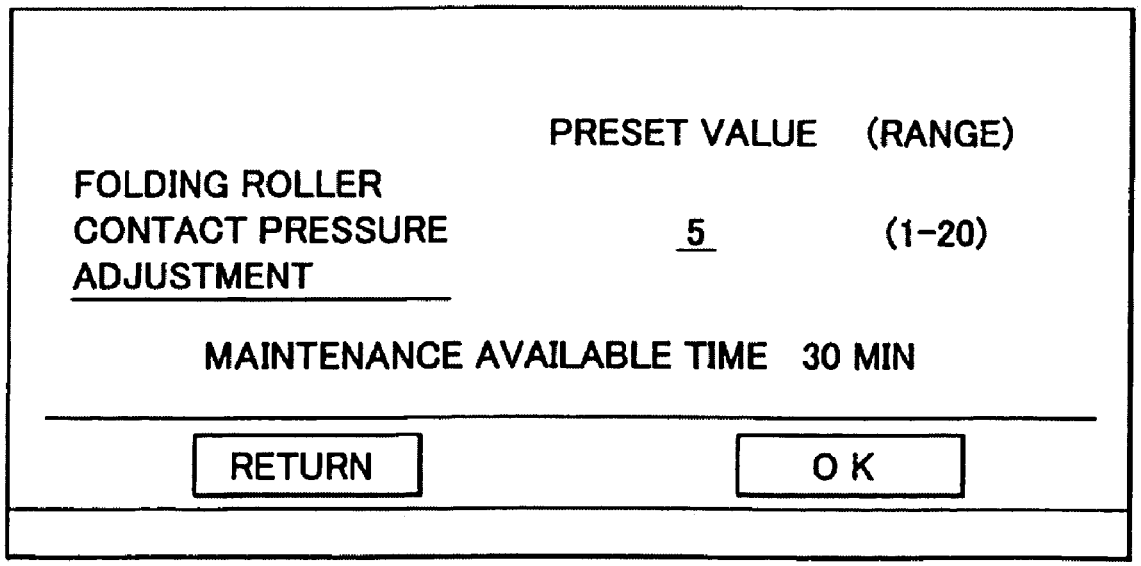
FIG. 19B is a drawing showing a returned screen example from the warning screen.

Next, the operation screen during maintenance will be described with reference to FIGS. 17A to 19B. FIGS. 17A to 18C are drawings showing operation screen examples during maintenance; FIG. 19A is a drawing showing a warning screen example when the maintenance available time is reduced; and FIG. 19B is a drawing showing a returned screen example from the warning screen.

If the maintenance key 417 of the operation display 400 is pushed down by a user, the operation display control unit 401 displays a first maintenance device selection screen on the liquid crystal display 420 (FIGS. 17A and 17B). On the maintenance device selection screen, the maintenance possibility state and the time available for maintenance (maintenance available time) are displayed for each processing module (unit or device). Wherein, the maintenance-possible processing module (unit or device) is high-lighted while the maintenance-impossible processing module is shaded. The maintenance available time displayed for each processing module is a period of time by the registered job uses the corresponding processing module in the next. Whereas, the processing module not used by the registered job is displayed as the maximum time 999 minutes while the presently executing module is displayed as "0".

In this example, the executing job is in "single-sided image-forming mode as well as sort processing mode" (the first job shown in FIG. 15A); and the next registered jobs are in "double-sided image-forming mode as well as bookbinding processing mode" (the second job shown in FIG. 15A) and "single-sided image-forming mode as well as folding processing mode" (the third job shown in FIG. 15A). In this example, since "printer" and "finisher" on the selection screen of the maintenance device are the processing modules used by executing jobs, the maintenance thereof is prohibited so that the display on the touch panel is shaded and the maintenance available time is displayed as "0 min" (FIGS. 17A and 17B).

Since "double-sided unit" and "bookbinding device" are the processing modules used for executing the job "double-sided image-forming mode as well as bookbinding processing mode" registered in the second, the maintenance is possible and the display thereof on the touch panel is high-lighted. The maintenance available time thereof is displayed as 30 minutes, which is the executing time of the executing job (FIG. 17A).

Since "automatic document feeder" is not the processing module used for executing the registered job, the maintenance is possible and the display thereof on the touch panel is high-lighted. The maintenance available time thereof is displayed as 999 minutes, which is the maximum maintenance available time (FIG. 17B).

Next, since "folding device" is the module used for executing the job in "single-sided image-forming mode as well as folding processing mode" registered in the third, the maintenance is possible and the display thereof on the touch panel is high-lighted. The thereof is displayed as 120 minutes, which is the sum of the executing time of the executing job, 30 minutes, and the second registered job executing time, 90 minutes, which is 120 minutes (FIG. 17B). In addition, "folding device" shown in FIG. 17B is reverse displayed because it is displayed as being selected for maintenance.

If a user pushes down a corresponding screen position of the first maintenance device selection screen displayed on the liquid crystal display 420 so as to select the processing module for maintenance from selectable processing modules (key having the module name displayed thereon is pushed down by the user), the selection screen of the maintenance unit of the processing module selected by the user is displayed (FIG. 17C). The screen example shown in FIG. 17B is the maintenance unit selection screen of the folding device when the folding device is selected on the screen. Then, when the user pushes down a corresponding screen position on the selection screen so as to select the unit for maintenance, the menu of maintenance items about the unit selected by the user is displayed (FIG. 18A). If the user pushes down a corresponding screen position on the selection screen shown in FIG. 18A so as to select the maintenance item, the detail of the maintenance item is displayed (FIG. 18B). If the user pushes down a corresponding screen position on the selection screen shown in FIG. 18B so as to select the maintenance item, the executing screen for setting the selected maintenance item and the maintenance available time are displayed (FIG. 18C). This screen shown in FIG. 18C is the screen during the maintenance.

If the maintenance available time is reduced by canceling a job during the maintenance, the message (in this example, "the maintenance available time is changed" is displayed) shown in FIG. 19A is displayed on the screen shown in FIG. 18C. Simultaneously, the operation display control unit 401 generates a warning sound from the warning buzzer 421 based on the instruction from the CPU circuit 150 of the image-forming apparatus body 10. Then, after the confirmation by the user, if the "OK" key on the message screen is pushed, as shown in FIG. 19B, the message is eliminated and the reduced maintenance available time is displayed. Also, the warning buzzer 421 is stopped.

Figure 20:
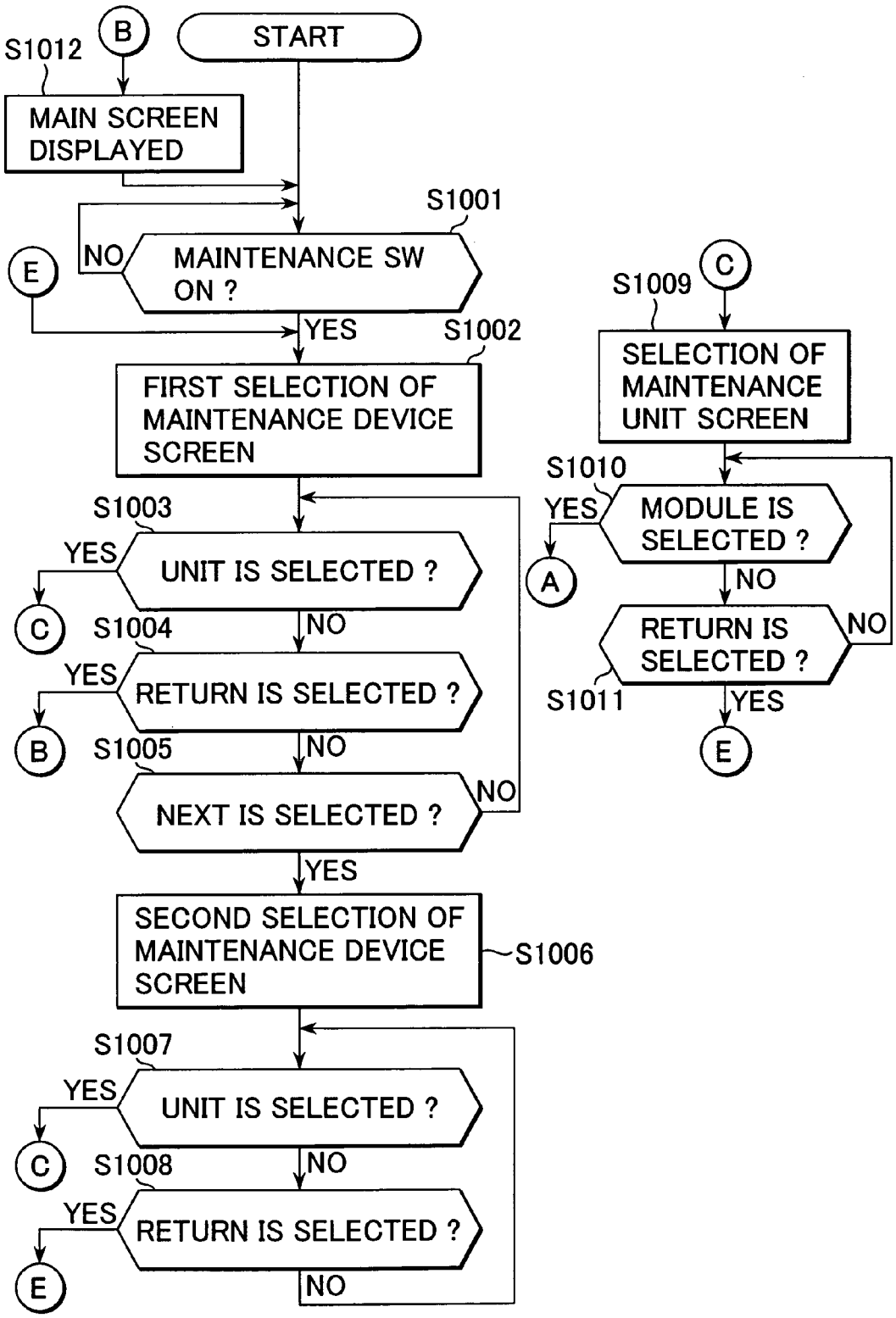
FIG. 20 is a flowchart showing a procedure of display processing of the operation screen during maintenance.
Figure 21:
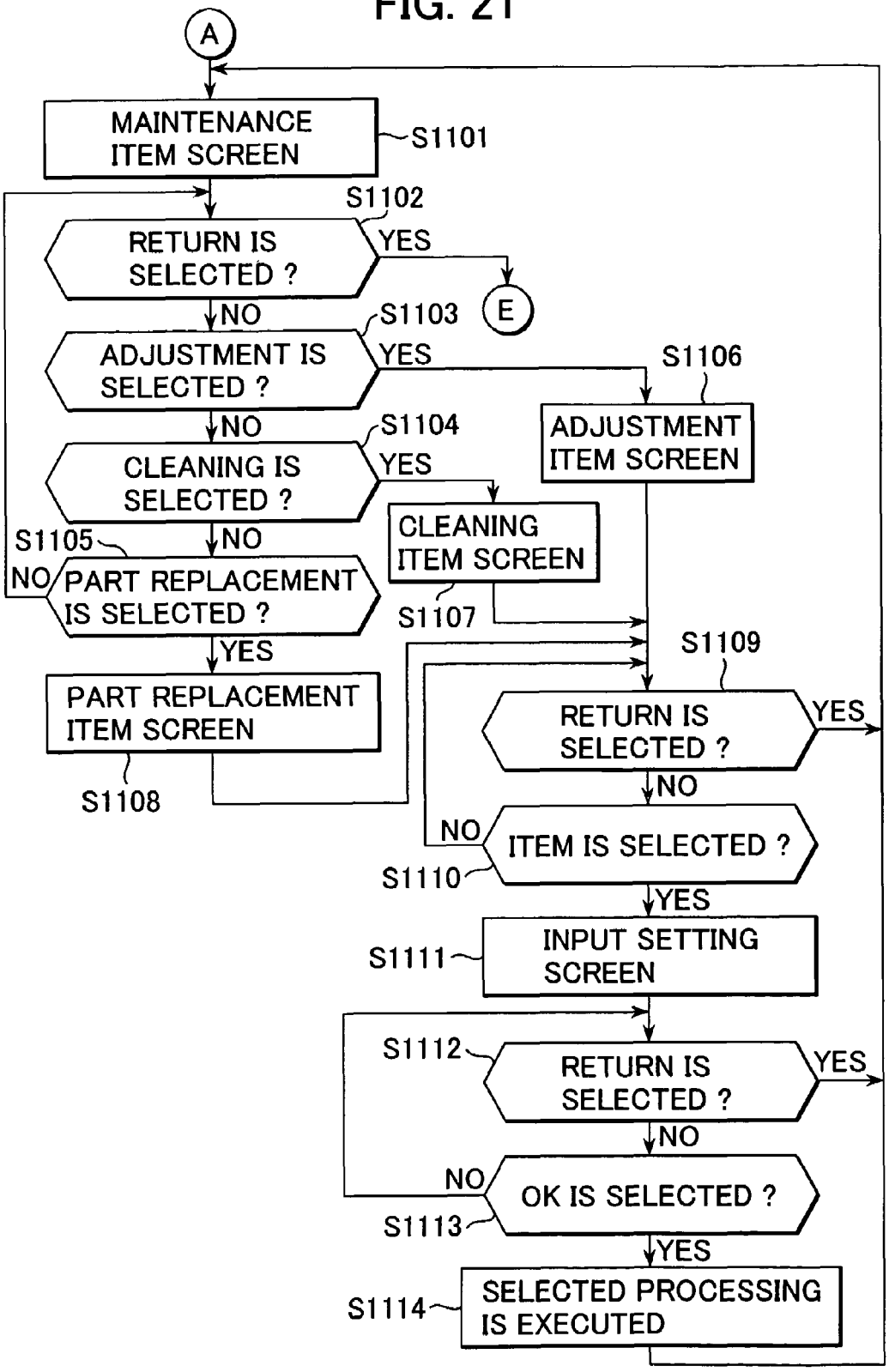
FIG. 21 is a flowchart showing a procedure of display processing of the operation screen during maintenance.

Next, display processing of the operation screen during the maintenance will be described with reference to FIGS. 20 and 21. FIGS. 20 and 21 are flowcharts showing the procedure of the display processing of the operation screen during the maintenance. This processing is performed by the CPU 461 in the operation display control unit 401.

As shown in FIG. 20, after the maintenance key (maintenance SW) 417 on the operation display 400 is pushed down by a user at first in Step S1001, the CPU 461 displays the first maintenance device selection screen (FIG. 17A) for selecting a processing module for maintenance in Step S1002. Then, the CPU 461 determines whether the processing module for maintenance is selected by the user on the first maintenance device selection screen in Step S1003. If it is determined that the processing module for maintenance is selected by the user on the first maintenance device selection screen, the CPU 461 executes Step S1009.

By contrast, if it is determined that the processing module for maintenance is not selected on the first maintenance device selection screen, the CPU 461 determines whether "return" is selected on the first maintenance device selection screen in Step S1004. If it is determined that "return" is selected by the user on the first maintenance device selection screen, the CPU 461 displays a main screen in Step S1012

(FIG. 14A). If it is determined that "return" is not selected on the first maintenance device selection screen, the CPU 461 determines whether "to next" is selected in Step S1015. If it is determined that "to next" is not selected, the CPU 461 returns to the Step S1003.

If it is determined that "to next" is selected in Step S1005, the CPU 461 displays a second maintenance device selection screen (FIG. 17B) for selecting a processing module for maintenance in Step S1006. Then, the CPU 461 determines whether the processing module for maintenance is selected on the second maintenance device selection screen in Step S1007. If it is determined that the processing module for maintenance is selected by the user on the second maintenance device selection screen, the CPU 461 executes Step S1009.

By contrast, if it is determined that the processing module for maintenance is not selected on the second maintenance device selection screen, the CPU 461 determines whether "return" is selected on the second maintenance device selection screen in Step S1008. If it is determined that "return" is selected by the user on the second maintenance device selection screen, the CPU 461 again executes the Step S1002. If it is determined that "return" is not selected by the user on the second maintenance device selection screen, the CPU 461 again returns to the Step S1007.

In Step S1009, the CPU 461 displays a maintenance unit selection screen (FIG. 17C) for selecting a unit for maintenance. Then, the CPU 461 determines whether the module is selected by the user on the maintenance unit selection screen in Step S1010. If it is determined that the maintenance unit is selected on the maintenance unit selection screen, the CPU 461 executes Step S1101 shown in FIG. 21. By contrast, if it is determined that the maintenance unit is not selected by the user on the maintenance unit selection screen, the CPU 461 determines whether "return" is selected on the maintenance unit selection screen in Step S1011. If it is determined that "return" is selected by the user on the maintenance unit selection screen, the CPU 461 again returns to the Step S1002. If it is determined that "return" is not selected by the user on the maintenance unit selection screen, the CPU 461 again returns to the Step S1010.

In Step S1101, the CPU 461 displays a maintenance item menu about the module (FIG. 18A) selected by a user in the Step S1007. The screen example shown in FIG. 18A will be described below. The CPU 461 determines whether "return" is selected in Step S1102. If it is determined that "return" is selected by the user, the CPU 461 again returns to the Step S1002.

In the Step S1102, if it is determined that "return" is not selected, the CPU 461 determines whether an adjustment item is selected in Step S1103. Wherein, if it is determined that the adjustment item is not selected, the CPU 461 determines whether a cleaning item is selected in Step S1104. If it is determined that the cleaning item is not selected, the CPU 461 determines whether a part-replacement item is selected in Step S1105. Then, if it is determined that the part-replacement item is not selected, the CPU 461 again returns to the Step S1102.

In the Step S1103, if it is determined that the adjustment item display is selected, the CPU 461 displays adjustment maintenance menu (FIG. 18B) about the module selected by a user in Step S1106. Then, the CPU 461 executes Step S1109. In the Step S1104, if it is determined that a cleaning item display is selected, the CPU 461 displays a cleaning maintenance item menu (not shown) about the module selected by the user in Step S1107. Then, the CPU 461 executes the Step S1109. In the Step S1105, if it is determined that a part-replacement item display is selected, the CPU 461 displays a part-replacement maintenance item menu (not shown) about the module selected by the user in Step S1108. Then, the CPU 461 executes the Step S1109.

In Step S1109, the CPU 461 determines whether "return" is selected. If it is determined that "return" is selected, the CPU 461 again returns to the Step S1101. By contrast, if it is determined that "return" is not selected, the CPU 461 determines whether the maintenance item is selected in Step S1110. If it is determined that the maintenance item is not selected, the CPU 461 again returns to the Step S1109.

In the Step S1110, if it is determined that the maintenance item is selected, the CPU 461 displays an input setting screen (FIG. 18C) in Step S1111. Then, the CPU 461 determines whether "return" is selected on the input setting screen in Step S1112. Wherein, it is determined that "return" is selected, the CPU 461 again returns to the Step S1101. By contrast, if it is determined that "return" is not selected, the CPU 461 determines whether "OK" is selected in Step S1113. If it is determined that "OK" is not selected, the CPU 461 again returns to the Step S1112. By contrast, if it is determined that "OK" is selected in Step S1114, the CPU 461 executes the maintenance about the maintenance selected by the user and executes the input. Then, the CPU 461 again returns to the Step S1101.

Figure 22:
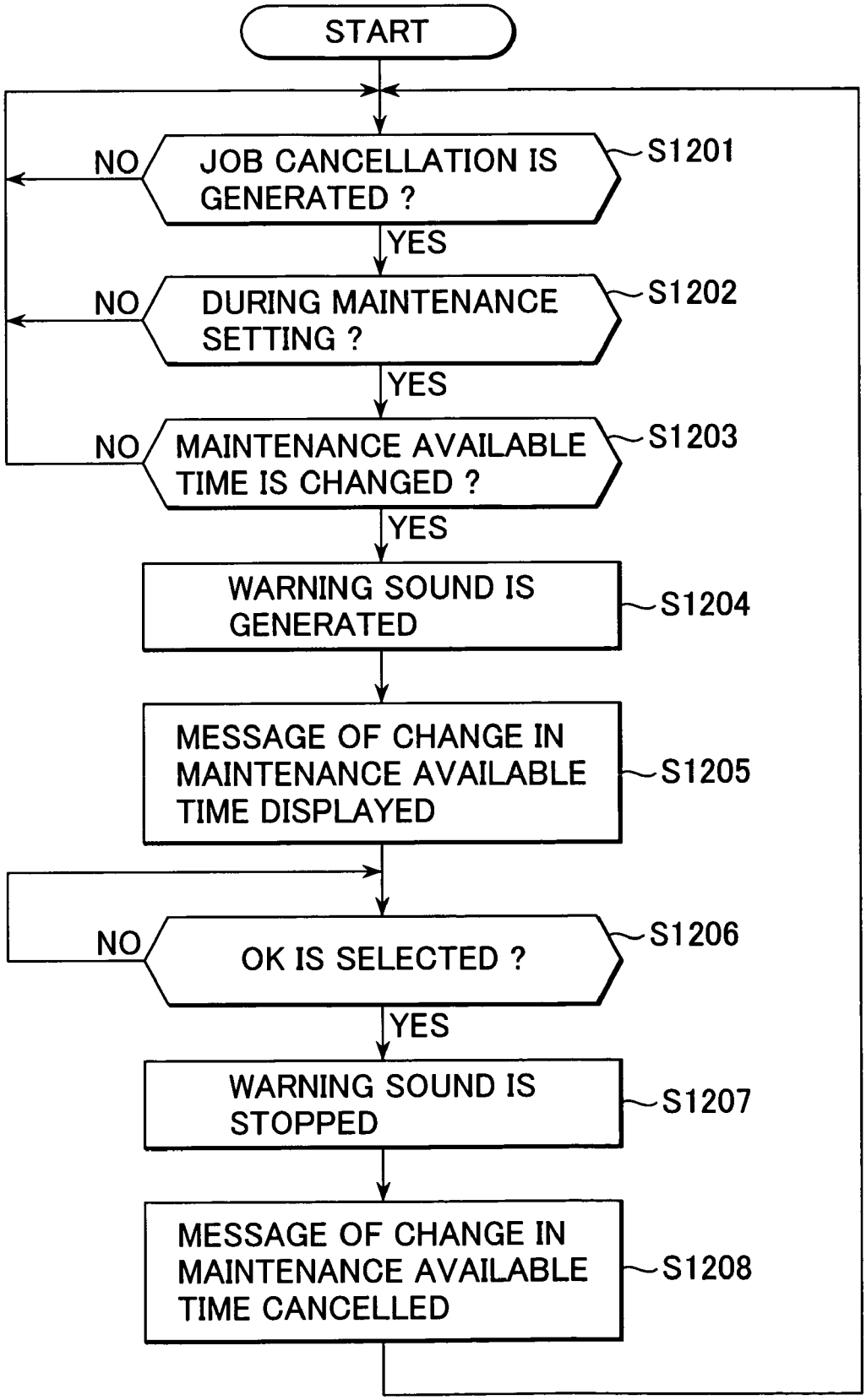
FIG. 22 is a flowchart showing the procedure of the processing during job cancellation.

Next, the processing during job cancellation will be described with reference to FIG. 22. FIG. 22 is a flowchart showing the procedure of the processing during job cancellation. This procedure is executed by the CPU circuit 150 according to a program stored in the ROM 151.

The CPU circuit 150, as shown in FIG. 22, supervises the generation of job cancellation in Step S1201. If a job is cancelled, it is determined whether it is during maintenance at present in Step S1202. During maintenance denotes the state that the screen on the operation display 400 becomes an input setting screen (FIG. 18C).

In the Step S1202, if it is determined that the maintenance is not performed, the procedure is returned to the Step S1201. By contrast, if it is determined that the maintenance is performed in Step S1202, the CPU circuit 150 determines whether the maintenance available time during maintenance setting is changed in Step S1203. The change in, the maintenance available time is produced when a job using the processing module during maintenance setting exists and also the cancelled job is executed prior to the job using the processing module during maintenance setting. If it is determined that the maintenance available time during maintenance setting is not changed, the procedure is returned to the Step S1201.

If it is determined that the maintenance available time during setting maintenance is changed in the Step S1203, a warning sound is generated from the warning buzzer 421 in Step S1204, and a message of change in the maintenance available time (FIG. 19A) is displayed in the following Step S1205. Then, the selection of "OK" is waited at Step S1206; upon selecting "OK", the warning sound is stopped in Step S1207, and the message of change in the maintenance available time is eliminated while the maintenance time is replaced with the reduced maintenance time in the following Step S1208.

In such a manner, according to the embodiment, the maintenance possibility is displayed every processing module or every maintenance item, and the maintenance available time is further displayed, so that the system shutdown due to the maintenance can be avoided to the utmost. If a registered job is cancelled so as to reduce the maintenance available time, since the reduction in the maintenance available time is informed to a user with the warning sound and the message, even use of the processing module during maintenance is advanced, the maintenance can be finished by the time that the processing module is used.

The display of the maintenance available time during job cancellation has been described above; alternatively, this processing may be performed every completion of the executing job.

Second Embodiment

Next, a second embodiment according to the present invention will be described with reference to the drawings.

The present embodiment is different from the first embodiment described above in respects of an operation screen for selecting the processing module for maintenance and the display processing of the operation screen.

First, the operation screen for selecting the processing module for maintenance will be described with reference to FIGS. 23 to 25. FIG. 23 is a drawing showing an operation screen example during maintenance under suspension of image-forming operation of an image-forming system according to the second embodiment of the present invention; and FIGS. 24 and 25 are drawings showing an operation screen example during maintenance under image-forming operation of the image-forming system according to the second embodiment of the present invention.

Figure 23A:
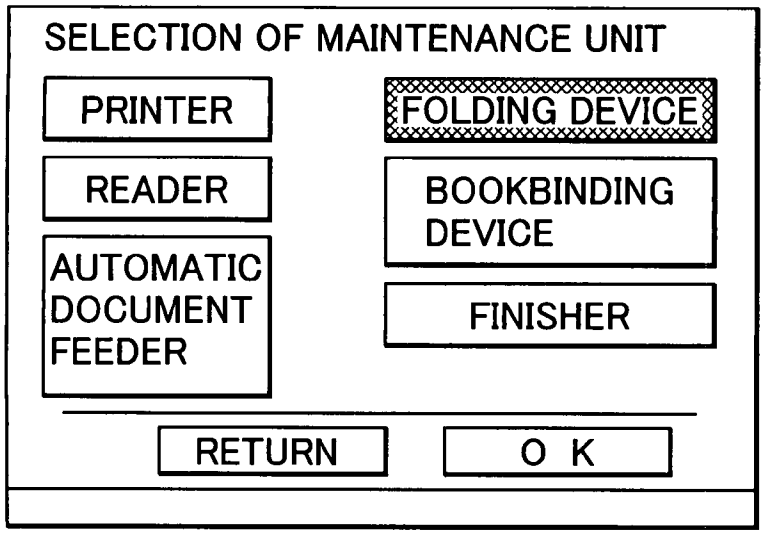
FIGS. 23A to 23D are drawings showing an operation screen example during maintenance under suspension of image-forming operation of an image-forming system according to a second embodiment of the present invention.
Figure 23B:
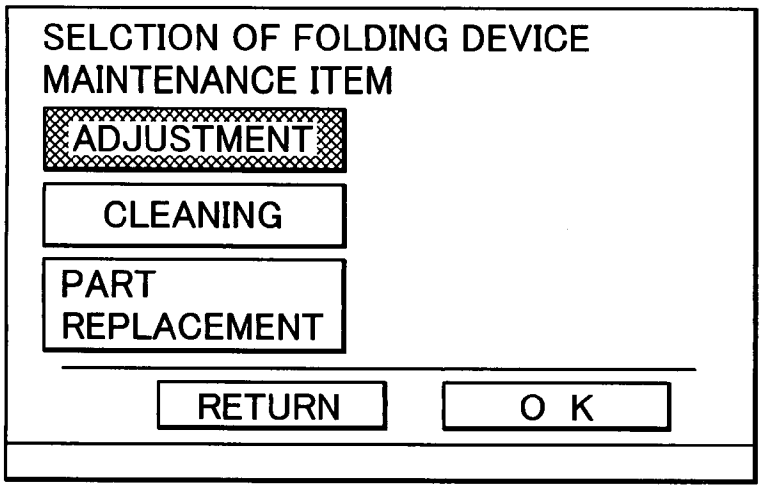
Figure 23C:
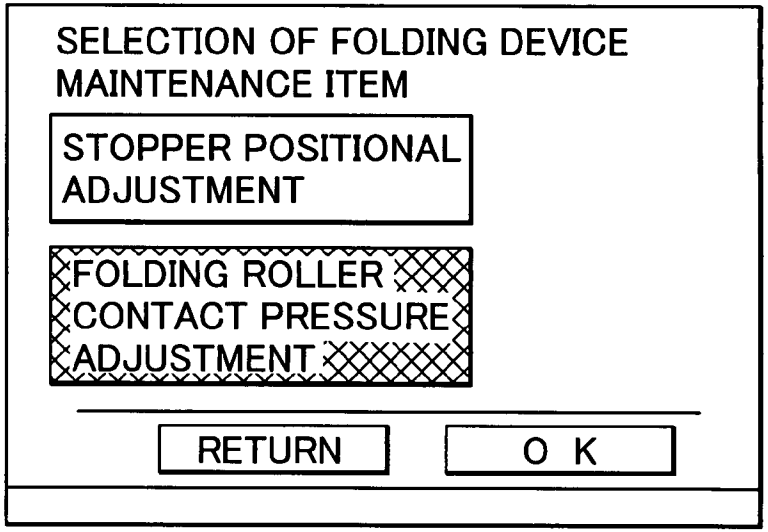
Figure 23D:
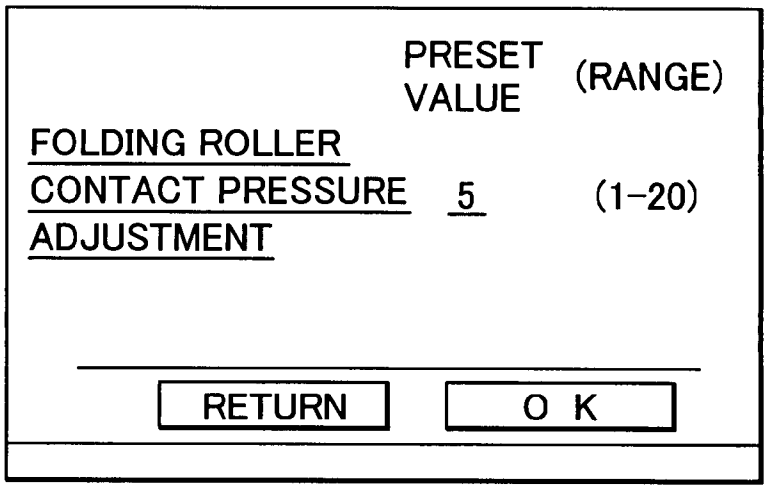

If the maintenance key 417 of the operation display 400 is pushed down by a user, the operation display control unit 401 displays a maintenance selection screen (FIG. 23A) on the liquid crystal display 420. When the image forming is not operated, the entire modules needing maintenance are displayed as a selection menu on the maintenance selection screen. If a user pushes down a corresponding screen position on the maintenance selection screen so as to select the module for maintenance from selectable processing modules, a maintenance item menu with respect to the module selected by the user is displayed (FIG. 23B). A screen example shown in FIGS. 23A and 23B shows a display example of the maintenance items when the folding device is selected. When the user pushes down a corresponding screen position on the menu screen so as to select a maintenance item, details of the selected maintenance item are displayed (FIG. 23C). If the user pushes down a corresponding screen position on the screen shown in FIG. 23C so as to select a maintenance item, a screen for setting and executing the selected maintenance is displayed (FIG. 23D).

Next, an operation screen under image-forming operation will be described with reference to FIGS. 24 and 25.

Figure 24A:
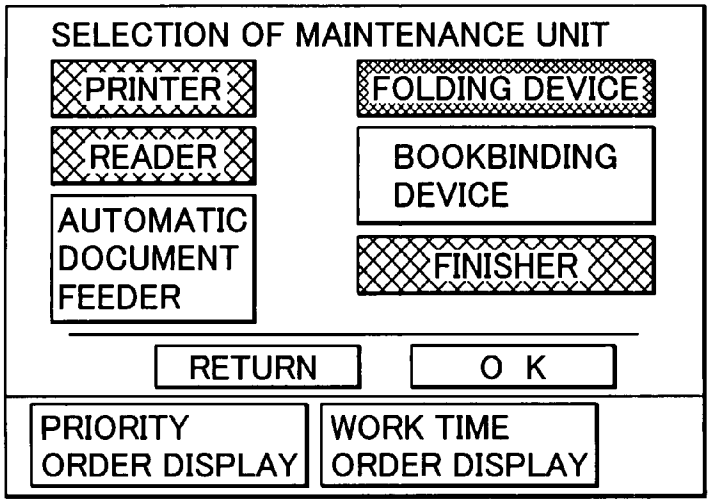
FIGS. 24A to 24D are drawings showing an operation screen example during maintenance under image-forming operation of the image-forming system according to the second embodiment of the present invention.

During image-forming operation, if the maintenance key 417 of the operation display 400 is pushed down by a user, the entire modules needing maintenance are displayed as a selection menu, while the processing module used for image-forming operation, i.e., the maintenance-impossible processing module, is displayed by shading, preventing the selection thereof (FIG. 24A).

A button is displayed for selecting whether a priority order display or a work-time order display. Wherein the priority order display indicates a sort display with respect to the entire maintenance-possible modules arranged in order of value of an operation counter exceeding the next maintenance counting value, i.e., in necessity order of maintenance. The work-time order display, in the case where one or more jobs are registered other than the job being executed, indicates a sort display with respect to the entire maintenance-possible modules arranged in order of period until the processing module is used longer than the maintenance work time thereof, in comparison between the period until the corresponding module for the registered job is used and a standard work time necessary for maintenance.

Figure 24B:
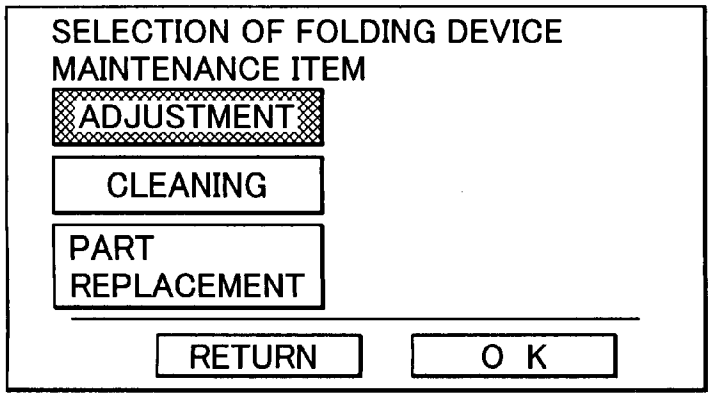
Figure 24C:
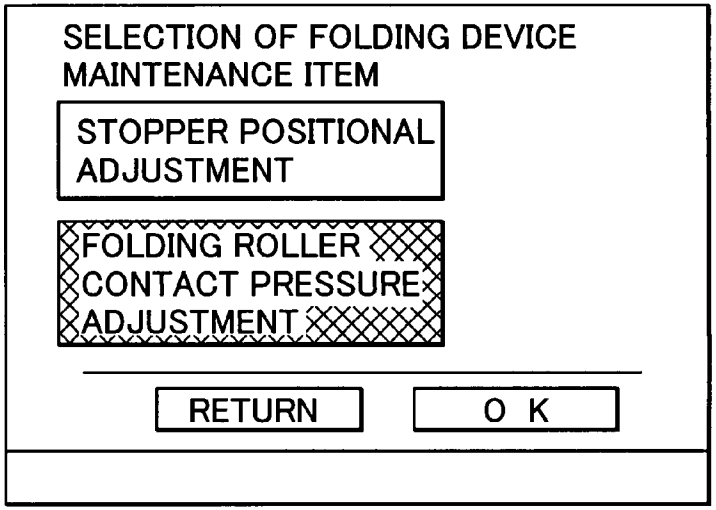
Figure 24D:
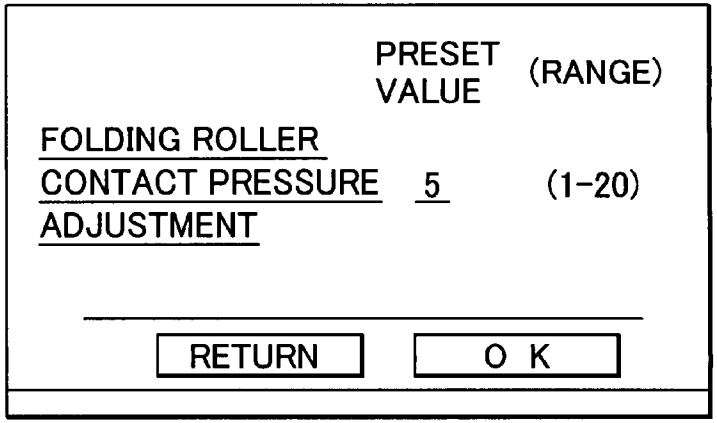

On the selection screen shown in FIG. 24A, if a user pushes down a touch panel on the liquid crystal display 420 so as to select a module for maintenance from selectable modules, a maintenance item menu with respect to the module selected by the user is displayed (FIG. 24B). On the selection screen shown in FIG. 24B, if a corresponding screen position is pushed down so as to select a maintenance item, details of the selected maintenance item are displayed (FIG. 24C). Each maintenance item is displayed so as to be capable of detecting whether it is in a selectable (executable) state. On the screen shown in FIG. 24C, if a corresponding screen position is pushed down so as to select a maintenance item, a setting and executing screen of the selected maintenance is displayed (FIG. 24D).

On the selection screen shown in FIG. 24A, if a corresponding screen position is pushed down so as to select the priority order display, a sort-displayed screen arranged in necessity order of maintenance is displayed (FIG. 25A). On the selection screen shown in FIG. 24A, if a corresponding screen position is pushed down so as to select the work-time order display, a sort-displayed screen arranged in allowance order of a maintenance work time is displayed (FIG. 25B).

Next, an operation screen display processing during maintenance will be described with reference to FIGS. 26 to 29. FIGS. 26 to 29 are flowcharts showing a procedure of operation screen display processing during maintenance of the image-forming system according to the second embodiment of the present invention. This processing is executed by the CPU 461 in the operation display control unit 401.

Figure 26:
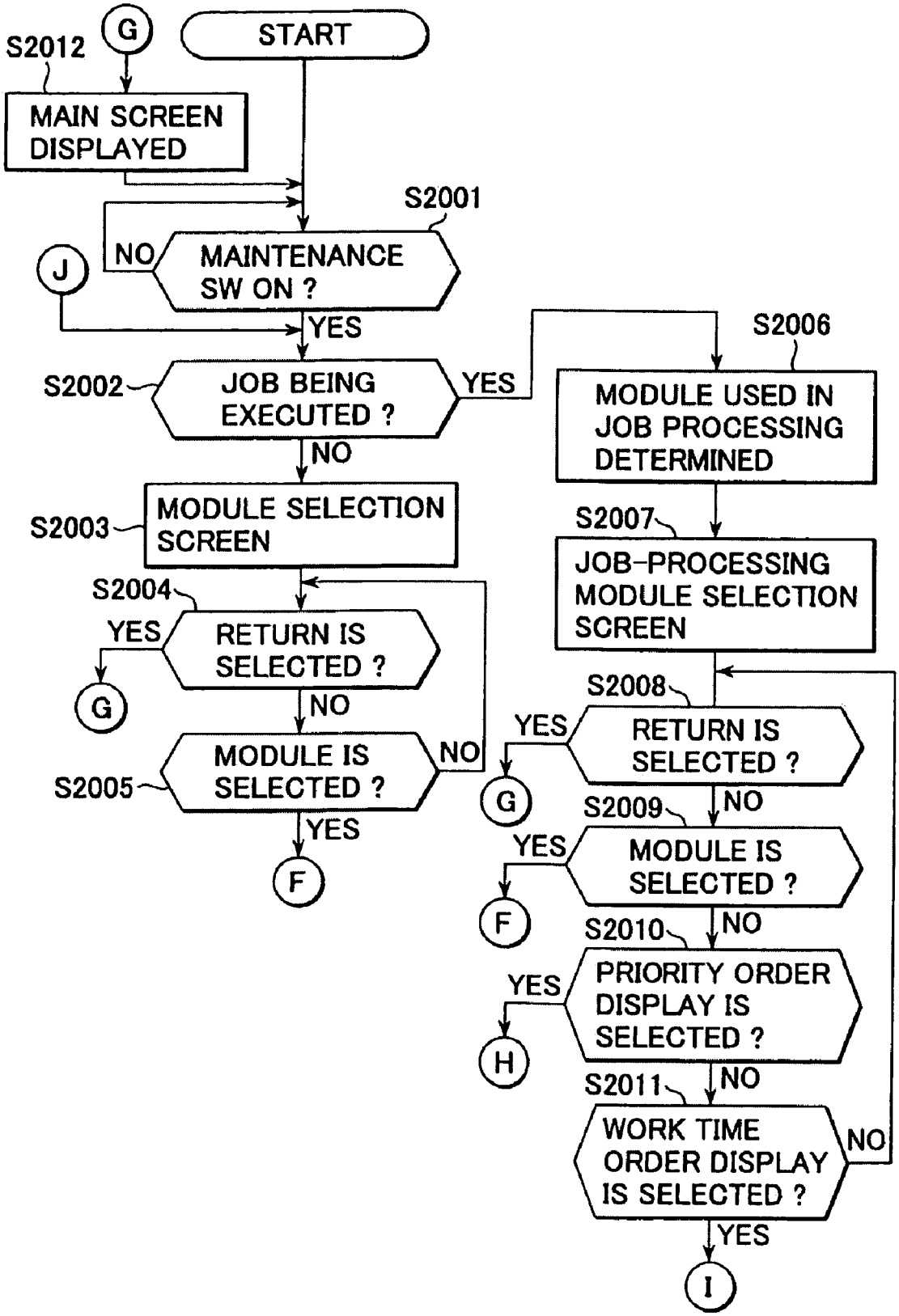
FIG. 26 is a flowchart showing a procedure of operation screen display processing during maintenance of an image-forming system according to the second embodiment of the present invention.

First, the CPU 461, as shown in FIG. 26, waits for the maintenance key (maintenance SW) 417 of the operation display 400 to be pushed down by a user in Step S2001. If it is determined that the maintenance key 417 is pushed down, the CPU 461 determines whether the job is executed in Step S2002. If it is determined that the job is executed, the CPU 461 executes Step S2006. By contrast, if it is determined that the job is not executed, the CPU 461 displays a processing module selection screen (FIG. 23A) selectable the entire processing modules needing maintenance in Step S2003. Then, the CPU 461 determines whether "return" is selected by the user on the processing module selection screen in Step S2004.

In the Step S2004, if it is determined that "return" is selected on the module selection screen, the CPU 461 displays a main screen in Step S2012. By contrast, in the Step S2004, if it is determined that "return" is not selected on the module selection screen, the CPU 461 determines whether the processing module is selected in Step S2005. If it is determined that the processing module is not selected, the CPU 461 again executes the Step S2004. By contrast, if it is determined that the processing module is selected, the CPU 461 executes the Step S2101 shown in FIG. 27.

In Step S2006, the CPU 461 determines the processing module used in the presently executed job. Then, the CPU 461 displays the entire modules necessary for maintenance in Step S2007, and displays the processing module presently used in image-forming operation by shading it while displaying a module selection screen (FIG. 24A) impossible to be selected.

Then, the CPU 461 determines whether "return" is selected by a user on the module selection screen in Step S2008. If it is determined that "return" is selected by the user, the CPU 461 executes the Step S2012. Whereas, if it is determined that "return" is not selected by the user, the CPU 461 determines whether the processing module is selected in Step S2009, so that the CPU 461 executes the Step S2101 shown in FIG. 27 if it is determined that the processing module is selected.

In the Step S2009, if it is determined that the processing module is not selected, the CPU 461 determines whether a priority order display is selected on the module selection screen (FIG. 24A) in Step S2010. If it is determined that the priority order display is selected, the CPU 461 executes the Step S2201 shown in FIG. 28. By contrast, if it is determined that the priority order display is not selected, the CPU 461 determines whether a work-time order display is selected on the module selection screen (FIG. 24A) in Step S2011. If it is determined that the work-time order display is selected, the CPU 461 executes the Step S2301 shown in FIG. 29. If it is determined that the work-time order display is not selected, the CPU 461 again executes the Step S2008.

Figure 27:
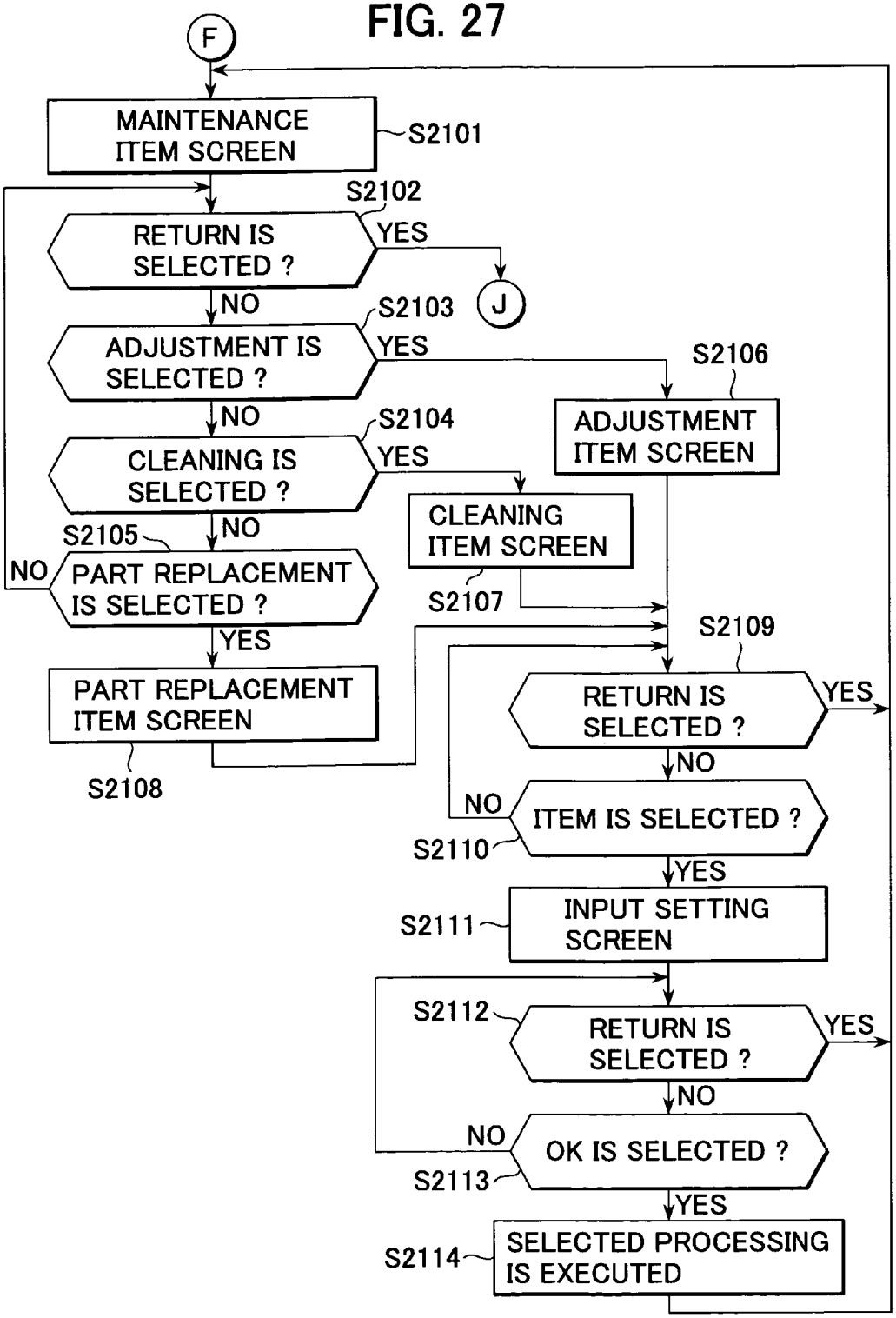
FIG. 27 is a flowchart showing a procedure of operation screen display processing during maintenance of the image-forming system according to the second embodiment of the present invention.

In the Step S2005 or S2009, if it is determined that the processing module is selected, the CPU 461 displays a maintenance item menu (FIG. 23B or FIG. 24B) with respect to the processing module selected by a user in the Step S2101 shown in FIG. 27. Then, the CPU 461 determines whether "return" is selected by the user on the maintenance item menu in Step S2102. If it is determined that "return" is selected, the CPU 461 again executes the Step S2002. By contrast, if it is determined that "return" is not selected, the CPU 461 determines whether an adjustment item display is selected in Step S2103.

In the Step S2103, if it is determined that the adjustment item display is not selected, the CPU 461 determines whether a cleaning item display is selected in Step S2104. If it is determined that the cleaning item display is not selected, the CPU 461 determines whether a part-replacement item display is selected in Step S2105. If it is determined that the part-replacement item display is not selected, the CPU 461 again executes the Step S2102.

In the Step S2103, if it is determined that the adjustment item display is selected, the CPU 461 displays an adjustment-maintenance item menu (FIG. 23C or FIG. 24C) with respect to the module selected by a user in Step S2106, and it executes Step S2109.

In the Step S2104, if it is determined that the cleaning item display is selected, the CPU 461 displays a cleaning maintenance item menu (not shown) with respect to the module selected by a user in Step S2107, and it executes the Step S2109.

In the Step S2105, if it is determined that the part-replacement item display is selected, the CPU 461 displays a part-replacement maintenance item menu (not shown) with respect to the module selected by a user, and it executes the Step S2109.

In the Step S2109, the CPU 461 determines whether "return" is selected by a user. If it is determined that "return" is selected by the user, the CPU 461 executes the Step S2101. By contrast, if it is determined that "return" is not selected by the user, the CPU 461 determines whether a maintenance executing and setting input screen display is selected. If it is determined that this screen display is not selected, the CPU 461 again executes the Step S2109.

In the Step S2110, if it is determined that the maintenance executing and setting input screen display is selected, the CPU 461 displays the maintenance executing and setting input screen (FIG. 23D or FIG. 24D) in Step S2111, and it determines whether "return" is selected by a user in Step S2112. If it is determined that "return" is selected by the user, the CPU 461 again executes the Step S2101. By contrast, if it is determined that "return" is not selected by the user, the CPU 461 determines whether "OK" is selected by the user in Step S2113; if it is determined that "OK" is not selected, it again executes the Step S2112. If it is determined that "OK" is selected, the CPU 461 performs the maintenance execution and the setting input with respect to the selected maintenance in Step S2114. Then, the CPU 461 again executes the Step S2101.

Figure 28:
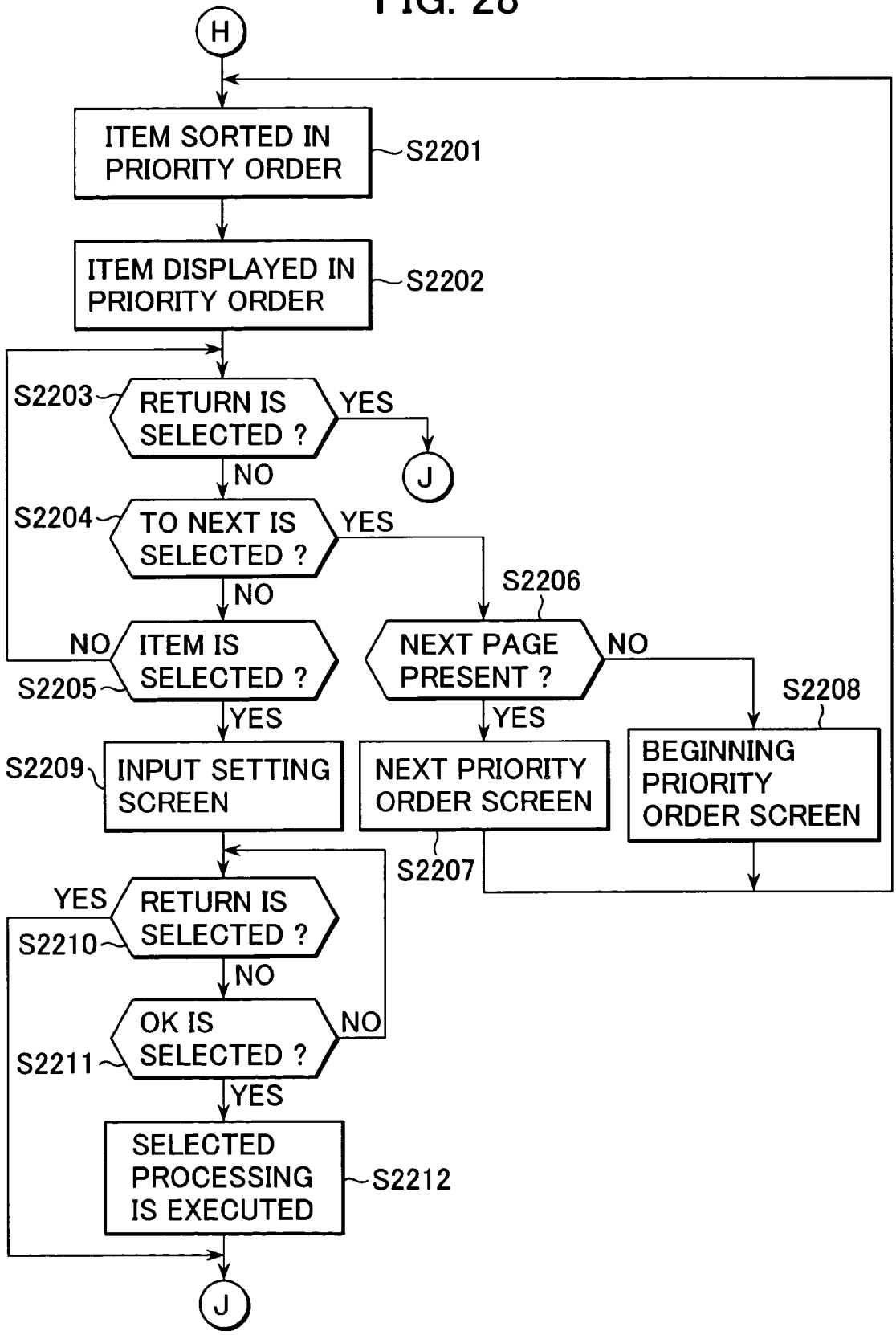
FIG. 28 is a flowchart showing a procedure of operation screen display processing during maintenance of the image-forming system according to the second embodiment of the present invention.

In the Step S2010, if it is determined that the priority order display is selected, the CPU 461 compares the presently operating counter value of each maintenance item with the next maintenance predestinate counter value so as to arrange the values in order of value of the present counter exceeding the next maintenance predestinate counter value in the Step S2201 shown in FIG. 28. Then, the CPU 461 displays the maintenance items rearranged in necessity order of maintenance on the screen (the priority order display screen shown in FIG. 25A) in Step S2202.

Next, the CPU 461 determines whether "return" is selected on the priority order display screen by a user in Step S2203. If it is determined that "return" is selected by the user, the CPU 461 again brings the processing back to the Step S2002. By contrast, if it is determined that "return" is not selected by the user, the CPU 461 determines whether "to next" is selected on the priority order display screen in Step S2204. If it is determined that "to next" is not selected, the CPU 461 determines whether the maintenance item is selected on the priority order display screen in Step S2205, so that if it is determined that the maintenance item is not selected, the CPU 461 again executes the Step S2203.

In the Step S2204, if it is determined that "to next" is selected by a user in the Step S2204, the CPU 461 determines whether the next page (the maintenance item to be displayed in the next) exists in Step S2206. If it is determined that the next page exists, the CPU 461 displays the next page (the next priority order display screen) in Step S2207, and again executes the Step S2203. By contrast, if it is determined that the next page does not exist, the CPU 461 displays the beginning page (the priority order display screen displayed in the first) in Step S2208, and the CPU 461 again brings the processing back to the Step S2003.

In the Step S2205, if it is determined that an maintenance item is selected by a user, the CPU 461 displays an input setting and the maintenance to be executed screen, the maintenance being selected by the user, (FIG. 24D) in Step S2209. Then, the CPU 461 determines whether "return" is selected on the input setting screen in Step S2210 so as to bring the processing back to the Step S2202 if it is determined that "return" is selected by the user. By contrast, if it is determined that "return" is not selected by the user, the CPU 461 determines whether "OK" is selected on the input setting screen in Step S2211. If it is determined that "OK" is not selected on the input setting screen, the CPU 461 brings the processing back to the Step S2210.

In the Step S2211, if it is determined that "OK" is selected by a user, the CPU 461 executes the selected maintenance and the inputting in Step S2212, and it brings the processing back to the Step S2002.

Figure 29:
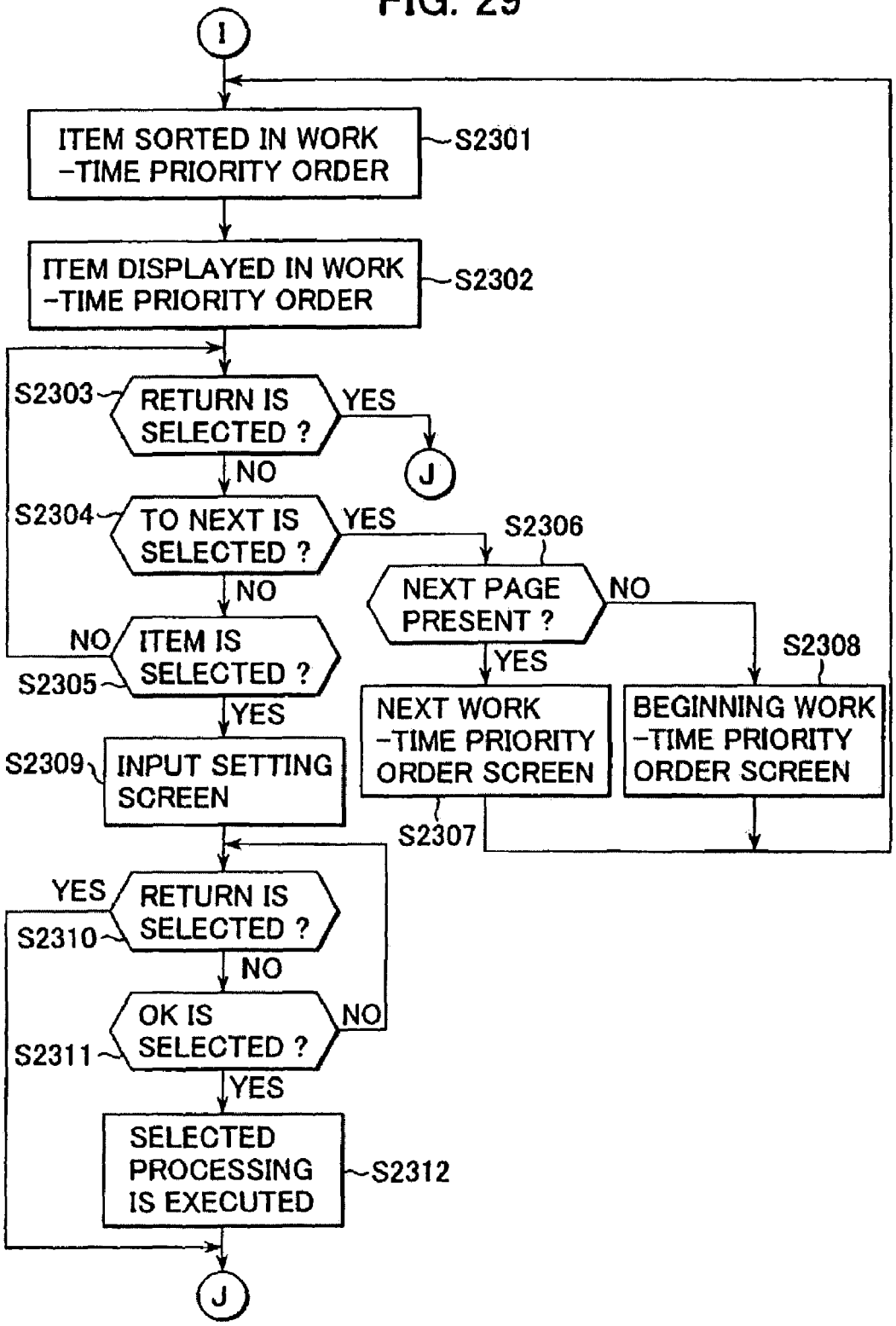
FIG. 29 is a flowchart showing a procedure of operation screen display processing during maintenance of the image-forming system according to the second embodiment of the present invention.
Figure 30:
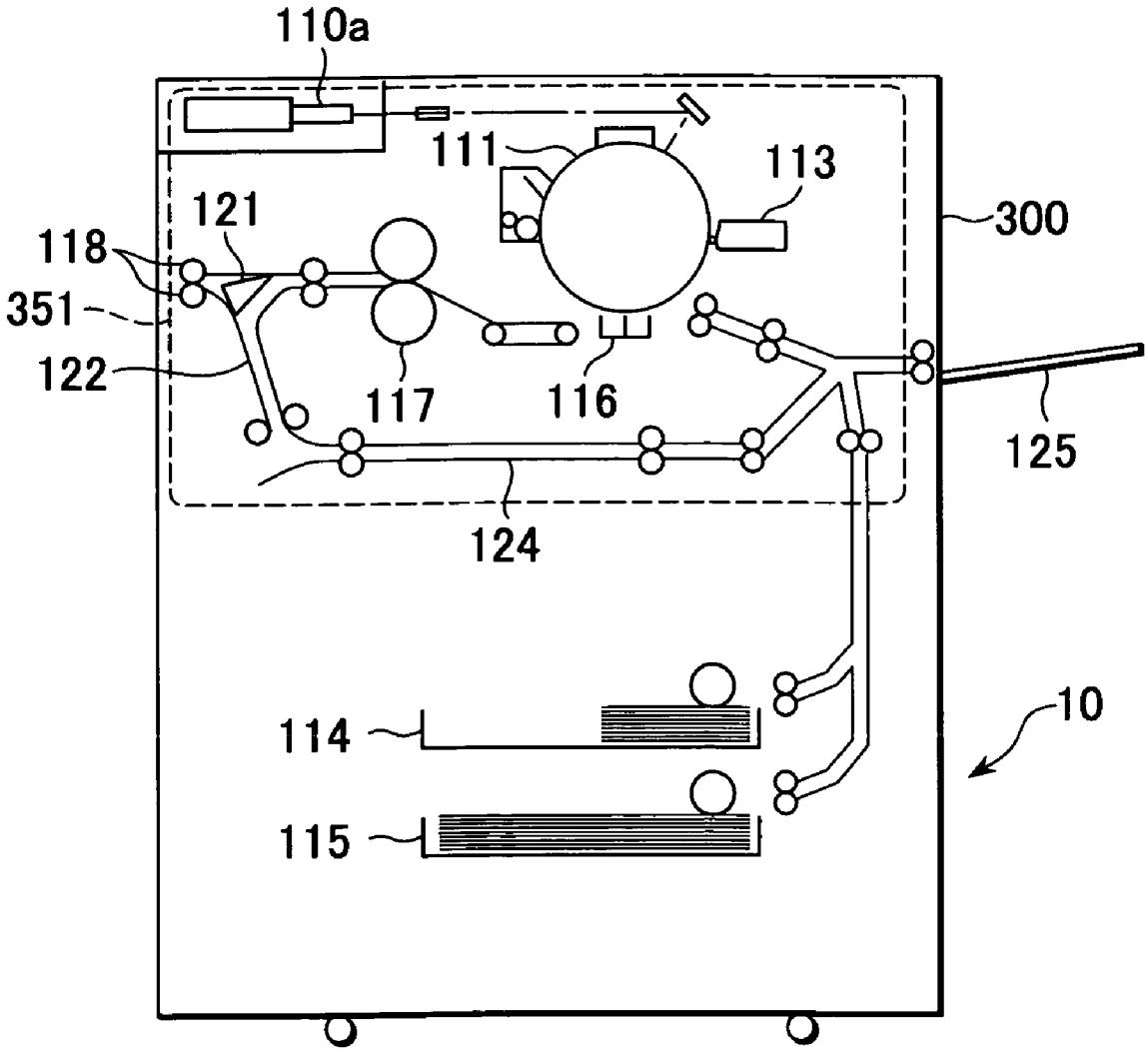
FIG. 30 PRIOR ART
FIG. 30 is a longitudinal sectional view of an essential part of a conventional image-forming apparatus.

In the Step S2011, if it is determined that the work-time order display is selected, the CPU 461 compares a period until the module is used by the registered job (module standby period) with a standard work time necessary for maintenance, the module being corresponding to one of and as well as relating to the entire maintenance-possible modules, so as to rearrange the periods in order of the standby period longer than the maintenance standard work time in the Step 52301 shown in FIG. 29. Then, the CPU 461 displays the rearranged maintenance items as the work-time order display (FIG. 25B) in Step S2302.

Then, in Step S2303, the CPU 461 determines whether "return" is selected on the work-time order display screen by a user, so that the CPU 461 brings the processing back to the Step S2002 if it is determined that "return" is selected. By contrast, if it is determined that "return" is not selected, the CPU 461 determines whether "to next" is selected on the work-time order display screen in Step S2304. If it is determined that "to next" is not selected, the CPU 461 determines whether the maintenance item is selected on the work-time order display screen in Step S2305. The CPU 461 brings the processing back to the Step S2303 again if it is determined that the maintenance item is not selected.

In the Step S2304, if it is determined that "to next" is selected by a user, the CPU 461 determines whether the next page (the maintenance item to be displayed in the next) does exist in Step S2306. If it is determined that the next page exists, the CPU 461 displays the next page (the next work-time order display screen) in Step S2307, and it brings the processing back to the Step S2301 again. By contrast, if it is determined that the next page does not exist, the CPU 461 displays the beginning page (the work-time order display screen displayed in the first) in Step S2308, and it brings the processing back to the Step S2301 again.

In the Step S2305, if it is determined that the maintenance item is selected by a user, the CPU 461 displays the input setting and the maintenance to be executed screen, the maintenance being selected by the user, (FIG. 24D) in Step S2309. Then, the CPU 461 determines whether "return" is selected on the input setting screen in Step S2310 so as to bring the processing back to the Step S2002 again if it is determined that "return" is selected by the user. By contrast, if it is determined that "return" is not selected by the user, the CPU 461 determines whether "OK" is selected on input setting screen in Step S2311. If it is determined that "OK" is not selected on input setting screen, the CPU 461 brings the processing back to the Step S2310.

In the Step S2311, if it is determined that "OK" is selected by a user, the CPU 461 performs the maintenance execution and the setting input with respect to the selected maintenance in Step S2312, and it brings the processing back to the Step S2002.

In such a manner, according to the embodiment, since the maintenance can be carried out during the image-forming operation by selecting any one of the priority order display and the work-time order display, user-friendly maintenance assistance can be provided.

The object of the present invention can also be of course achieved by supplying a storage medium (or a recording medium) having program cords of software for achieving functions of the embodiments described above to the system or the device so that the system or a computer (or a CPU or a MPU) of the device reads out and executes the program cords stored in the storage medium. In this case, the program cord itself, which is read out of the storage medium, achieves the function of the embodiment, so that the storage medium having the program cord stored therein is incorporated in the present invention. Also, by executing the program cord read out by the computer, it is obvious that not only the functions of the embodiments described above are achieved but also an operating system (OS) operating on the computer executes part of or the entire of the practical processing based on the instruction of the program cords so as to achieve the functions of the embodiments mentioned above.

Furthermore, after the program cord read out of the storage medium is written in a feature expansion card inserted into a computer or in a memory provided in a feature expansion unit connected to a computer, a CPU provided in the feature expansion card or the feature expansion unit executes part of or the entire of the practical processing based on the instruction from the program cord, thereby obviously achieving the functions of the embodiments described above.

As described above, on the basis of contents of a job presently in execution and contents of jobs registered in a job registration unit, the possibility of maintenance is determined for each processing module so as to display the determined result, so that the system shutdown due to the maintenance can be avoided to the utmost.

Also, on the basis of contents of a job presently in execution and contents of jobs registered in the job registration unit, the maintenance available time is calculated for each processing module so as to display the calculated maintenance available time for each processing module, so that the system shutdown due to the maintenance can be avoided to the utmost.

If a registered job is cancelled so as to reduce the maintenance available time, since the reduction in the maintenance available time is informed to a user with a warning sound and a message, even use of the processing module during maintenance is advanced, the maintenance can be finished by the time that the processing module is used.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image-forming apparatus comprising:

a plurality of processing modules;

job registering means capable of registering a plurality of jobs;

determining means for determining maintenance availability of each of the plurality of processing modules based on contents of a job presently in execution and contents of jobs registered in the job registering means; and displaying means for displaying determined results of the determining means.

2. An apparatus according to claim 1, wherein the displaying means displays the determined result of the determining means for every one of the processing modules.

3. An apparatus according to claim 1, wherein the displaying means displays the determined result of the determining means for every one of maintenance items.

4. An apparatus according to claim 3, wherein the maintenance items are displayed by putting them in order of maintenance necessity.

5. An apparatus according to claim 3, wherein the maintenance items are displayed by putting them in order of brevity of maintenance working hours.

6. An image-forming apparatus comprising:

a plurality of processing modules;

job registering means capable of registering a plurality of jobs;

calculating means for calculating an available period of time for maintenance for every one of the processing modules based on contents of a job presently in execution and contents of jobs registered in the job registering means; and displaying means for displaying the available period of time for every one of the processing modules calculated by the calculating means.

7. An apparatus according to claim 6, wherein the displaying means displays the available period of time for maintenance calculated by the calculating means for every one of the processing modules.

8. An apparatus according to claim 6, wherein the displaying means displays the available period of time for maintenance calculated by the calculating means for every one of maintenance items.

9. An apparatus according to claim 8, wherein the maintenance items are displayed by putting them in order of maintenance necessity.

10. An apparatus according to claim 8, wherein the maintenance items are displayed by putting them in order of brevity of maintenance working hours.

11. An apparatus according to claim 6, further comprising:

determining means for determining presence of change in the available period of time for maintenance when cancellation is produced in the jobs registered in the job registering means during maintenance; and warning means for issuing a warning if the available period of time for maintenance of the processing module during maintenance is changed.

12. An apparatus according to claim 11, wherein the warning means displays information that the available period of time for maintenance of the processing module during maintenance is changed in the displaying means.

13. An apparatus according to claim 11, wherein the warning means issues a warning sound that the available period of time for maintenance of the processing module during maintenance is changed.

* * * * *

UNITED STATES PATENT AND TRADEMARK OFFICE

CERTIFICATE OF CORRECTION

PATENT NO. : 6,975,815 B2
APPLICATION NO. : 10/714947
DATED : December 13, 2005
INVENTOR(S) : Kato et al.

It is certified that error appears in the above-identified patent and that said Letters Patent is hereby corrected as shown below:

COLUMN 1
Line 58, “of a” should be deleted.

COLUMN 2
Line 31, “the-shutdown” should read --the shutdown--.

COLUMN 5
Line 28, “as” should be deleted.

COLUMN 6
Line 19, “is” should read --are--.

COLUMN 7
Line 10, “involving” should read --involved--.
Line 64, “exit.” should read --exit--.

COLUMN 8
Line 2, “whether” should read --either--.
Line 7, “a” should read --at a--.
Line 11, “a” should read --at a--.
Line 29, “whether” should read --either--.
Line 37, “stable” should read --staple--.

COLUMN 9
Line 57, “cover 5S2” should read --cover 552--.

COLUMN 11
Line 12, “turns” should read --turning--.

COLUMN 12
Line 53, “a” should read --as--.

UNITED STATES PATENT AND TRADEMARK OFFICE

CERTIFICATE OF CORRECTION

PATENT NO. : 6,975,815 B2
APPLICATION NO. : 10/714947
DATED : December 13, 2005
INVENTOR(S) : Kato et al.

It is certified that error appears in the above-identified patent and that said Letters Patent is hereby corrected as shown below:

COLUMN 16
Line 2, "thereof" should read --maintenance available time thereof--.

COLUMN 18
Line 42, "in," should read --in--.

COLUMN 19
Line 7, "performed" should read --performed after--.

COLUMN 22
Line 65, "Step 52301" should read --Step S2301--.

Signed and Sealed this

Fifteenth Day of April, 2008

JON W. DUDAS
*Director of the United States Patent and Trademark Office*